US011837137B2

(12) United States Patent
Peng et al.

(10) Patent No.: US 11,837,137 B2
(45) Date of Patent: Dec. 5, 2023

(54) DISPLAY PANEL, ELECTRONIC DEVICE AND METHOD FOR DRIVING DISPLAY PANEL

(71) Applicant: BOE Technology Group Co., Ltd., Beijing (CN)

(72) Inventors: Kuanjun Peng, Beijing (CN); Tieshi Wang, Beijing (CN); Hui Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 93 days.

(21) Appl. No.: 17/606,854

(22) PCT Filed: Jan. 6, 2021

(86) PCT No.: PCT/CN2021/070426
§ 371 (c)(1),
(2) Date: Oct. 27, 2021

(87) PCT Pub. No.: WO2022/147678
PCT Pub. Date: Jan. 4, 2022

(65) Prior Publication Data

US 2023/0142218 A1 May 11, 2023

(51) Int. Cl.
*G09G 3/20* (2006.01)

(52) U.S. Cl.
CPC ... *G09G 3/2003* (2013.01); *G09G 2300/0426* (2013.01); *G09G 2300/0452* (2013.01)

(58) Field of Classification Search
CPC ..... G09G 3/2003; G09G 2300/0426; G09G 2300/0452
See application file for complete search history.

(56) References Cited

U.S. PATENT DOCUMENTS 10,909,924 B2 2/2021 Yang et al.
2006/0001617 A1 1/2006 Shin et al.
(Continued)

FOREIGN PATENT DOCUMENTS

CN 1728222 A 2/2006
CN 1975846 A 6/2007
(Continued)

OTHER PUBLICATIONS

International Search Report dated Aug. 30, 2021, issued in counterpart International application No. PCT/CN2021/070426. (6 pages).
(Continued)

*Primary Examiner* — Kenneth B Lee, Jr.
(74) *Attorney, Agent, or Firm* — WHDA, LLP

(57) ABSTRACT

A display panel, an electronic device and a method are provided. The display panel includes: a base substrate; a plurality of sub-pixels arranged in a matrix; a plurality of data lines and a plurality of gate lines, the data line intersect the gate line; at least some of the plurality of sub-pixels are divided into a plurality of sub-pixel association groups, each sub-pixel association group includes a plurality of sub-pixels of a same color electrically connected to a same data line; the display panel further includes an associated pixel control circuit configured to independently perform data writing on the plurality of sub-pixels of the same color in the sub-pixel association group in the first image display mode; and synchronously perform data writing on the plurality of sub-pixels of the same color electrically connected to the same data line in the sub-pixel association group in the second image display mode.

19 Claims, 19 Drawing Sheets

(56) References Cited

U.S. PATENT DOCUMENTS

| | | | | |
|---|---|---|---|---|
| 2007/0126671 | A1 | 6/2007 | Naoaki | |
| 2008/0068524 | A1 | 3/2008 | Kim | |
| 2017/0213522 | A1* | 7/2017 | Xie | G09G 5/04 |
| 2020/0118476 | A1* | 4/2020 | Kim | G09G 3/2003 |
| 2020/0243003 | A1* | 7/2020 | Yang | G09G 3/3233 |

FOREIGN PATENT DOCUMENTS

| | | | |
|---|---|---|---|
| CN | 104752468 | A | 7/2015 |
| CN | 107342047 | A | 11/2017 |
| CN | 110517636 | A | 11/2019 |
| CN | 111292665 | A | 6/2020 |

OTHER PUBLICATIONS

Written Opinion dated Aug. 30, 2021, issued in counterpart International application No. PCT/CN2021/070426. (6 pages).

* cited by examiner

DISPLAY PANEL, ELECTRONIC DEVICE AND METHOD FOR DRIVING DISPLAY PANEL

TECHNICAL FIELD

This application is a Section 371 National Stage Application of International Application No. PCT/CN2021/070426, filed on Jan. 6, 2021, entitled "DISPLAY PANEL, ELECTRONIC DEVICE AND METHOD FOR DRIVING DISPLAY PANEL" incorporated herein by reference in their entirety.

TECHNICAL FIELD

The present disclosure relates to a field of display technology, and in particular to a display panel, an electronic device and a method for driving a display panel.

BACKGROUND

Display panels are widely used in various devices with display functions such as televisions, tablet computers, and computer monitors. With the development of technology and people's pursuit of high definition, the refresh rate and the resolution of the display panel are continuously increasing, which multiplies system resources and greatly increases the power consumption. In addition, with the development of 3D imaging technology, demands for pixels of 3D display panels, especially multi-view 3D display panels, may also increase significantly, resulting in greater demand for system resources.

SUMMARY

A display panel is provided according to embodiments of the present disclosure provide, including:

a base substrate; a plurality of sub-pixels arranged in a matrix; and a plurality of data lines extending along a first direction and a plurality of gate lines extending along a second direction, wherein the data line intersect the gate line; wherein at least some of the plurality of sub-pixels are divided into a plurality of sub-pixel association groups, each of the plurality of sub-pixel association groups includes a plurality of sub-pixels of a same color electrically connected to a same data line, and the display panel has a first image display mode and a second image display mode; and wherein the display panel further includes an associated pixel control circuit, configured to independently perform data writing on the plurality of sub-pixels of the same color in the sub-pixel association group in the first image display mode; and synchronously perform data writing on the plurality of sub-pixels of the same color electrically connected to the same data line in each of the plurality of sub-pixel association groups in the second image display mode.

In some embodiments, the plurality of sub-pixels are arranged in a sub-pixel matrix of M rows and N columns, each row of sub-pixels extends along the second direction, each column of sub-pixels extends along the first direction, each of the at least one data line is electrically connected to more than one sub-pixel of the same color in a same row of the sub-pixel matrix.

In some embodiments, each of the plurality of sub-pixel association groups includes sub-pixels in a plurality of rows of the sub-pixel matrix, in the first image display mode, more than one gate line respectively electrically connected to the plurality of sub-pixels of the same color in each of the plurality of sub-pixel association groups is scanned independently, in the second image display mode, more than one gate line respectively electrically connected to the plurality of sub-pixels of the same color in each of the plurality of sub-pixel association groups is scanned synchronously.

In some embodiments, the plurality of sub-pixels includes sub-pixels of a plurality of colors, colors of the sub-pixels in a same column of the sub-pixel matrix are the same, or sub-pixels of different colors are periodically arranged in the same column of the sub-pixel matrix.

In some embodiments, the same data line is electrically connected to more than one sub-pixel of the same color in the same row of the sub-pixel matrix through a switch element, or electrically connected to more than one sub-pixel of the same color in the same row of the sub-pixel matrix directly.

In some embodiments, the plurality of sub-pixels include a first color sub-pixel, a second color sub-pixel and a third color sub-pixel, the plurality of data lines include a first data line, a second data line and a third data line, each of the plurality of sub-pixel association groups includes a plurality of first color sub-pixels electrically connected to the first data line, a plurality of second color sub-pixels electrically connected to the second data line, and a plurality of third color sub-pixels electrically connected to the third data line.

In some embodiments, colors of the sub-pixels in the same column of the sub-pixel matrix are the same, and the sub-pixels of different colors are periodically arranged one by one in the same row of the sub-pixel matrix, each row of sub-pixels extends along the second direction, each column of sub-pixels extends along the first direction, each of the at least one data line is electrically connected to more than one sub-pixel of the same color in the same row of the sub-pixel matrix, the plurality of gate lines include a first gate line, a second gate line, a third gate line and a fourth gate line, and the display panel further includes a first group of switches and a second group of switches, and a number of color types of the sub-pixels is G, wherein a data line connected to a $2nG+i_{th}$ column of sub-pixels is connected to a second node through a $nG+i_{th}$ switch in the first group of switches, and a data line connected to a $(2n+1)G+i_{th}$ column of sub-pixels is connected to the second node through a $(n+1)\ G+i_{th}$ switch in the second group of switches, wherein n is an integer greater than or equal to zero and less than or equal to (N/2G), and i is an integer greater than or equal to 1 and less than or equal to G; and wherein the associated pixel control circuit is configured so that: in the first image display mode, the first gate line scans and turns on the first row of sub-pixels in a first time period and a second time period, the second gate line scans and turns on the second row of sub-pixels in a third time period and a fourth time period, and the third gate line scans and turns on the third row of sub-pixels in a fifth time period and a sixth time period, and the fourth gate line scans and turns on the fourth row of sub-pixels in a seventh time period and an eighth time period, the first group of switches are turned on in the first time period, the third time period, the fifth time period and the seventh time period and turned off in the second time period, the fourth time period, the sixth time period, and the eighth time period, and the second group of switches are turned on in the second time period, the fourth time period, the sixth time period and the eighth time period and are turned off in the first time period, the third time period, the fifth time period and the seventh time period; and in the second image display mode, the first gate line and the second gate line scan and turn on the first row of sub-pixels and the second row of sub-pixels in the first time period and the second time period, and the third gate line and the fourth gate line scans and turns on the third row of sub-pixels and the fourth row of sub-pixels in the second time period and the third time period, the first group of switches and the second group of switches are kept on in the first time period, the second time period, the third time period and the fourth time period.

In some embodiments, colors of the sub-pixels in a same row of the sub-pixel matrix are the same, and each of the plurality of sub-pixel association groups includes a plurality of first color sub-pixels in the first row of the sub-pixel matrix electrically connected to the first data line, a plurality of second color sub-pixels in the second row of the sub-pixel matrix electrically connected to the second data line, a plurality of third color sub-pixels in the third row of the sub-pixel matrix electrically connected to the first data line, a plurality of first color sub-pixels in the fourth row of the sub-pixel matrix electrically connected to the second data line, a plurality of second color sub-pixels in the fifth row of the sub-pixel matrix electrically connected to the first data line, a plurality of third color sub-pixels in the sixth row of the sub-pixel matrix electrically connected to the second data line, and wherein the plurality of gate lines include a first gate line, a second gate line, a third gate line, a fourth gate line, a fifth gate line, a sixth gate line, a seventh gate line, an eighth gate line, a ninth gate line, a tenth gate line, an eleventh gate line and a twelfth gate line, the first gate line is electrically connected to an odd-numbered sub-pixel in the first row of the sub-pixel matrix, and the second gate line is electrically connected to an even-numbered sub-pixel in the first row of the sub-pixel matrix, the third gate line is electrically connected to an odd-numbered sub-pixel in the second row of the sub-pixel matrix, the fourth gate line is electrically connected to an even-numbered sub-pixel in the second row of the sub-pixel matrix, the fifth gate line is electrically connected to an odd-numbered sub-pixel in the third row of the sub-pixel matrix, the sixth gate line is electrically connected to an even-numbered sub-pixel in the third row of the sub-pixel matrix, the seventh gate line is electrically connected to an odd-numbered sub-pixel in the fourth row of the sub-pixel matrix, the eighth gate line is electrically connected to an even-numbered sub-pixel in the fourth row of the sub-pixel matrix, the ninth gate line is electrically connected to an odd-numbered sub-pixel in the fifth row of the sub-pixel matrix, the tenth gate line is electrically connected to an even-numbered sub-pixel in the fifth row of the sub-pixel matrix, the eleventh gate line is electrically connected to an odd-numbered sub-pixel in the sixth row of the sub-pixel matrix, the twelfth gate line is electrically connected to an even-numbered sub-pixel in the sixth row of the sub-pixel matrix, wherein the associated pixel control circuit is configured so that: in the first image display mode, the first gate line scans in a first time period, the second gate line and the third gate line scan in a second time period, the fourth gate line and the fifth gate line scan in a third time period, the sixth gate line and the seventh gate line scan in a fourth time period, and the eighth gate line and the ninth gate line scan in a fifth time period, the tenth gate line and the eleventh gate line scan in a sixth time period, and the twelfth gate line scans in a seventh time period; in the second image display mode, the first gate line, the second gate line, the seventh gate line, and the eighth gate line scan in the first time period and the second time period, and the third gate line, the fourth gate line, the ninth gate line and the tenth gate line scan in the third period and the fourth period, and the fifth gate line, the sixth gate line, the eleventh gate line and the twelfth gate line scan in the fifth time period and the sixth time period.

In some embodiments, the display panel is a multi-view three-dimensional display panel including a plurality of viewing angle display positions, each of the plurality of sub-pixel association groups includes a plurality of three-dimensional sub-pixel groups, and each of the plurality of three-dimensional sub-pixel groups includes sub-pixels of different colors for the plurality of viewing angle display positions.

In some embodiments, the multi-view three-dimensional display panel includes K viewing angle display positions, wherein K is an even number, each of the plurality of three-dimensional sub-pixel groups includes K/2 columns of sub-pixels, the sub-pixels of different colors include a first color sub-pixel, a second color sub-pixel, and a third color sub-pixel, a periodic unit is included in each column of sub-pixels, and each periodic unit is formed of two first color sub-pixels, two second color sub-pixels, and two third color sub-pixels in sequence.

In some embodiments, the display panel further includes a cylindrical lens array located on a light emitting side of the display panel, wherein an axis of the cylindrical lens in the cylindrical lens array extends along the first direction, orthographic projections of the plurality of sub-pixels on a base substrate are respectively inclined with respect to the first direction.

In some embodiments, the display panel further includes a cylindrical lens array located on a light emitting side of the display panel, wherein an axis of the cylindrical lens in the cylindrical lens array extends along the first direction, orthographic projections of the plurality of sub-pixels on a base substrate extend along the first direction, an even-numbered row of sub-pixels is staggered in the second direction by half a sub-pixel relative to an odd-numbered row of sub-pixels.

In some embodiments, the display panel further includes a cylindrical lens array located on a light emitting side of the display panel, an orthographic projection of the cylindrical lens in the cylindrical lens array on the base substrate has a broken line shape, the multi-view three-dimensional display panel includes K viewing angle display positions, K is a multiple of 4, each of the plurality of three-dimensional sub-pixel groups includes 4 rows of sub-pixels and K/4 columns of sub-pixels, a second row of sub-pixels and a third row of sub-pixels of each of the plurality of three-dimensional sub-pixel groups are staggered in the second direction by one sub-pixel relative to a first row of sub-pixels and a fourth row of sub-pixels of said each of the plurality of three-dimensional sub-pixel groups.

In some embodiments, the plurality of three-dimensional sub-pixel groups includes a first three-dimensional sub-pixel group and a second three-dimensional sub-pixel group adjacent in the second direction, each group of three-dimensional sub-pixel groups includes J columns of sub-pixels, and each of the J columns of sub-pixels is connected to a data line, the display panel further includes a first group of switches and a second group of switches, the number of switches in each of the first group of switches and the second group of switches is not less than J, wherein a data line connected to a $H_{th}$ column of sub-pixels in the first three-dimensional sub-pixel group is connected to a first node through a $H_{th}$ switch in the first group of switches, and a data line connected to a $H_{th}$ column of sub-pixels in the second three-dimensional sub-pixel group is connected to the first node through a $H_{th}$ switch in the second group of switches, H and J are integers, and H is less than or equal to J.

In some embodiments, a refresh rate of the first image display mode is lower than a refresh mode of the second image display mode, and a resolution of the first image display mode is higher than a resolution of the second image display mode.

A method for driving the display panel as described above is further provided according to the embodiments of the present disclosure, including: independently performing data writing on the plurality of sub-pixels of the same color in the sub-pixel association group in the first image display mode; and synchronously performing data writing on the plurality of sub-pixels of the same color electrically connected to the same data line in each of the plurality of sub-pixel association groups in the second image display mode.

In some embodiments, the plurality of gate lines includes a first gate line and a second gate line, the plurality of sub-pixels are arranged as a sub-pixel matrix of M rows and N columns, each row of sub-pixels extends along the second direction, each column of sub-pixels extends along the first direction, each of the at least one data line is electrically connected to more than one sub-pixel of a same color in a same row of the sub-pixel matrix, and wherein in the first image display mode, the first gate line scans and turns on an odd-numbered sub-pixel in a first row of sub-pixels in a first time period, the second gate line scans and turns on an even-numbered sub-pixel in the first row of sub-pixels in a second time period; and in the second image display mode, the first gate line and the second gate line scan and turn on each sub-pixel in the first row of sub-pixels in the first period.

In some embodiments, the plurality of sub-pixels are arranged as a sub-pixel matrix of M rows and N columns, each row of sub-pixels extends along the second direction, each column of sub-pixels extends along the first direction, each of the at least one data line is electrically connected to more than one sub-pixel of the same color in the same row of the sub-pixel matrix, and each data line is electrically connected to one sub-pixel in the same row of the sub-pixel matrix, and is electrically connected to other sub-pixels of the same color in the same row through a switch element, and wherein the switch element is turned off in the first image display mode, and the switch element is turned on in the second image display mode.

In some embodiments, the plurality of sub-pixels are arranged as a sub-pixel matrix of M rows and N columns, the plurality of sub-pixels includes sub-pixels of a plurality of colors, colors of the sub-pixels in a same column of the sub-pixel matrix are the same, and the sub-pixels of different colors are periodically arranged one by one in the same row of the sub-pixel matrix, each row of sub-pixels extends along the second direction, each column of sub-pixels extends along the first direction, each of the at least one data line is electrically connected to more than one sub-pixel of the same color in the same row of the sub-pixel matrix, the plurality of gate lines include a first gate line, a second gate line, a third gate line and a fourth gate line, and the display panel further includes a first group of switches and a second group of switches, and a number of color types of the sub-pixels is G, wherein a data line connected to a $2nG+i_{th}$ column of sub-pixels is connected to a second node through a $nG+i_{th}$ switch in the first group of switches, and a data line connected to a $(2n+1)G+i_{th}$ column of sub-pixels is connected to the second node through a $(n+1)\ G+i_{th}$ switch in the second group of switches, wherein n is an integer greater than or equal to zero and less than or equal to (N/2G), and i is an integer greater than or equal to 1 and less than or equal to G; and in the first image display mode, the first gate line scans and turns on the first row of sub-pixels in a first time period and a second time period, the second gate line scans and turns on the second row of sub-pixels in a third time period and a fourth time period, and the third gate line scans and turns on the third row of sub-pixels in a fifth time period and a sixth time period, and the fourth gate line scans and turns on the fourth row of sub-pixels in a seventh time period and an eighth time period, the first group of switches are turned on in the first time period, the third time period, the fifth time period and the seventh time period and turned off in the second time period, the fourth time period, the sixth time period, and the eighth time period, and the second group of switches are turned on in the second time period, the fourth time period, the sixth time period and the eighth time period and are turned off in the first time period, the third time period, the fifth time period and the seventh time period; and in the second image display mode, the first gate line and the second gate line scan and turn on the first row of sub-pixels and the second row of sub-pixels in the first time period and the second time period, and the third gate line and the fourth gate line scans and turns on the third row of sub-pixels and the fourth row of sub-pixels in the second time period and the third time period, the first group of switches and the second group of switches are kept on in the first time period, the second time period, the third time period and the fourth time period.

In some embodiments, the plurality of sub-pixels are arranged as a sub-pixel matrix of M rows and N columns, each row of sub-pixels extend along the second direction, each column of sub-pixels extends along the first direction, the plurality of sub-pixels includes a first color sub-pixel, a second color sub-pixel, and a third color sub-pixel, and the plurality of data lines comprises a first data line, a second data line, and a third data line, and wherein colors of the sub-pixels in a same row of the sub-pixel matrix are the same, and each of the plurality of sub-pixel association groups comprises a plurality of first color sub-pixels in the first row of the sub-pixel matrix electrically connected to the first data line, a plurality of second color sub-pixels in the second row of the sub-pixel matrix electrically connected to the second data line, a plurality of third color sub-pixels in the third row of the sub-pixel matrix electrically connected to the first data line, a plurality of first color sub-pixels in the fourth row of the sub-pixel matrix electrically connected to the second data line, a plurality of second color sub-pixels in the fifth row of the sub-pixel matrix electrically connected to the first data line, a plurality of third color sub-pixels in the sixth row of the sub-pixel matrix electrically connected to the second data line, and wherein the plurality of gate lines include a first gate line, a second gate line, a third gate line, a fourth gate line, a fifth gate line, a sixth gate line, a seventh gate line, an eighth gate line, a ninth gate line, a tenth gate line, an eleventh gate line and a twelfth gate line, the first gate line is electrically connected to an odd-numbered sub-pixel in the first row of the sub-pixel matrix, and the second gate line is electrically connected to an even-numbered sub-pixel in the first row of the sub-pixel matrix, the third gate line is electrically connected to an odd-numbered sub-pixel in the second row of the sub-pixel matrix, the fourth gate line is electrically connected to an even-numbered sub-pixel in the second row of the sub-pixel matrix, the fifth gate line is electrically connected to an odd-numbered sub-pixel in the third row of the sub-pixel matrix, the sixth gate line is electrically connected to an even-numbered sub-pixel in the third row of the sub-pixel matrix, the seventh gate line is electrically connected to an odd-numbered sub-pixel in the fourth row of the sub-pixel matrix, the eighth gate line is electrically connected to an even-numbered sub-pixel in the fourth row of the sub-pixel matrix, the ninth gate line is electrically connected to an odd-numbered sub-pixel in the fifth row of the sub-pixel matrix, the tenth gate line is electrically connected to an even-numbered sub-pixel in the fifth row of the sub-pixel matrix, the eleventh gate line is electrically connected to an odd-numbered sub-pixel in the sixth row of the sub-pixel matrix, the twelfth gate line is electrically connected to an even-numbered sub-pixel in the sixth row of the sub-pixel matrix, in the first image display mode, the first gate line scans in a first time period, the second gate line and the third gate line scan in a second time period, the fourth gate line and the fifth gate line scan in a third time period, the sixth gate line and the seventh gate line scan in a fourth time period, and the eighth gate line and the ninth gate line scan in a fifth time period, the tenth gate line and the eleventh gate line scan in a sixth time period, and the twelfth gate line scans in a seventh time period; in the second image display mode, the first gate line, the second gate line, the seventh gate line, and the eighth gate line scan in the first time period and the second time period, and the third gate line, the fourth gate line, the ninth gate line and the tenth gate line scan in the third period and the fourth period, and the fifth gate line, the sixth gate line, the eleventh gate line and the twelfth gate line scan in the fifth time period and the sixth time period.

In some embodiments, the display panel is a multi-view three-dimensional display panel including a plurality of viewing angle display positions, each of the plurality of sub-pixel association groups includes a plurality of three-dimensional sub-pixel groups, and each of the plurality of three-dimensional sub-pixel groups includes sub-pixels of different colors for the plurality of viewing angle display positions, and the method includes: turning on different sub-pixels of the same color in a same viewing angle display position in a same sub-pixel association group one by one at different time periods in the first image display mode, and synchronously turning on the different sub-pixels of the same color in the same viewing angle display position in the same pixel association group in the second image display mode.

An electronic device is further provided according to the embodiments of the present disclosure, including the display panel according to any one of the above embodiments.

BRIEF DESCRIPTION OF THE DRAWINGS

Through the following description of the present disclosure with reference to the drawings, other features, purposes and advantages of the present disclosure will become apparent.

DETAILED DESCRIPTION OF EMBODIMENTS

Figure 1:
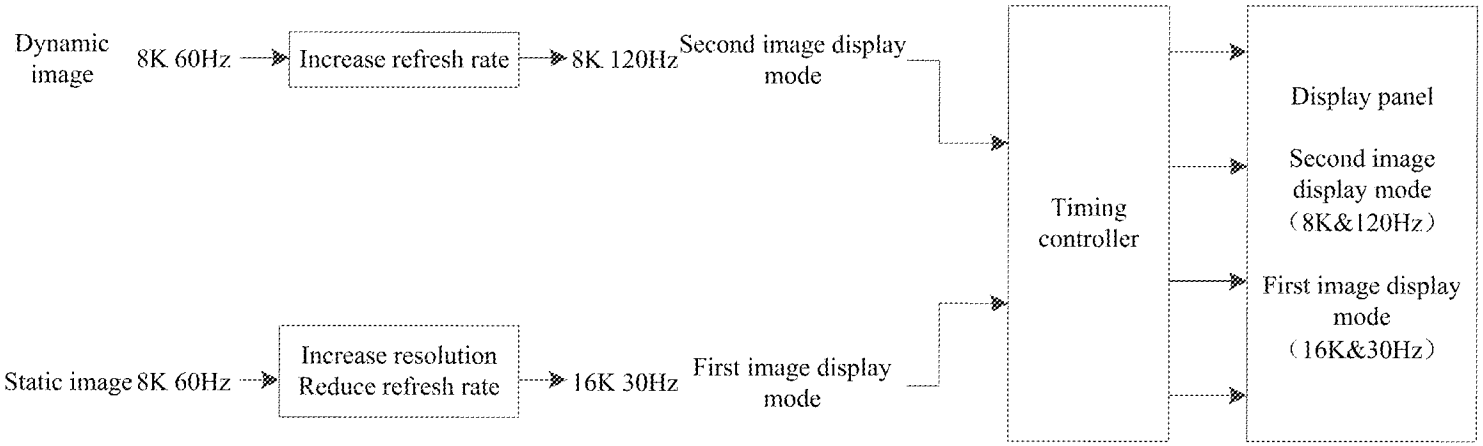
FIG. 1 is a schematic diagram of a principle of switching image display modes of a display panel according to some embodiments of the present disclosure.

The present disclosure will be further described in detail below with reference to the accompanying drawings and embodiments. It may be understood that the specific embodiments described here are only used to explain the related invention, but not to limit the present disclosure. In addition, it should be noted that, for ease of description, only the parts related to the invention are shown in the drawings.

It should be noted that the embodiments in the present disclosure and the features in the embodiments may be combined with each other if there is no conflict.

In addition, in the following detailed description, for ease of explanation, many specific details are set forth to provide a comprehensive understanding of the embodiments of the present disclosure. However, one or more embodiments may also be implemented without these specific details.

It should be understood that, although the terms first, second, etc. may be used herein to describe various elements, these elements should not be limited by these terms. These terms are only used to distinguish one element from another. For example, without departing from the scope of the exemplary embodiments, a first element may be named as a second element, and similarly, a second element may be named as a first element. The term "and/or" as used herein includes any and all combinations of one or more of the related listed items.

It should be understood that when an element or layer is referred to as being "formed on" another element or layer, the element or layer may be directly or indirectly formed on the other element or layer. That is, for example, there may be an intermediate element or an intermediate layer. In contrast, when an element or layer is referred to as being "directly formed on" another element or layer, there is no intervening element or intervening layer. Other words used to describe the relationship between elements or layers should be interpreted in a similar manner (for example, "between" and "directly between", "adjacent" and "directly adjacent", etc.).

The terms used herein are only for purpose of describing specific embodiments, and are not intended to limit the embodiments. As used herein, unless the context clearly dictates otherwise, a singular form is also intended to include a plural form. It should be understood that when the terms "comprise" and/or "include" are used herein, it means that described features, wholes, steps, operations, elements and/or components are present, but do not exclude a presence or addition of one or more other features, wholes, steps, operations, elements, components, and/or combinations thereof.

Herein, unless otherwise specified, the expressions "located on the same layer" and "arranged on the same layer" generally mean that a first component and a second component may be formed by using a same material and by a same patterning process. The expressions "located on different layers" and "arranged on different layers" generally mean that a first component and a second component are formed by different patterning processes.

When a display panel is displaying, required display parameters are different for different image frames. For example, when a dynamic image is displayed, a high refresh rate is often required, and when a static image is displayed, a high resolution is often particularly required, but the requirement for the refresh rate is lower than that of the dynamic image. Due to the current continuous pursuit of display effects, more and more system resources are required for display panels. Display parameters may be adjusted for different display images. For example, for dynamic images, a high refresh rate and low resolution mode may be provided, while for static images, a low refresh rate and high resolution mode may be provided. In this way, the system resources may be balanced, so that different display images may all have relatively good display effects when the system resources are limited.

FIG. 1 shows an exemplary principle concept of image display for different types of display images. As can be seen in FIG. 1, a system may perform different processing on a dynamic image and a static image. Assuming that a resolution and a refresh rate of the original dynamic image and the original static image are the same, the example in the drawing is a resolution of 8k and a refresh rate of 60 Hz. However, the following operations may be performed before an image is displayed, so as to improve a display effect. For the static image, the resolution of the static image is increased (for example, to 16k), and the refresh rate is reduced (for example, to 30 Hz); for the dynamic image, the refresh rate of the dynamic image is increased (for example, to 120 Hz). After the static image and dynamic image processed above passed through a timing controller, a first image display mode (used to display the static image with relatively high resolution and low refresh rate) and a second image display mode (used to display the dynamic image with relatively low resolution and high refresh rate) are formed on a display panel. The above solution for increasing or decreasing the resolution and the refresh rate of the image may be implemented by any existing technology for adjusting the image and the refresh rate, and will not be repeated here.

Figure 2A:
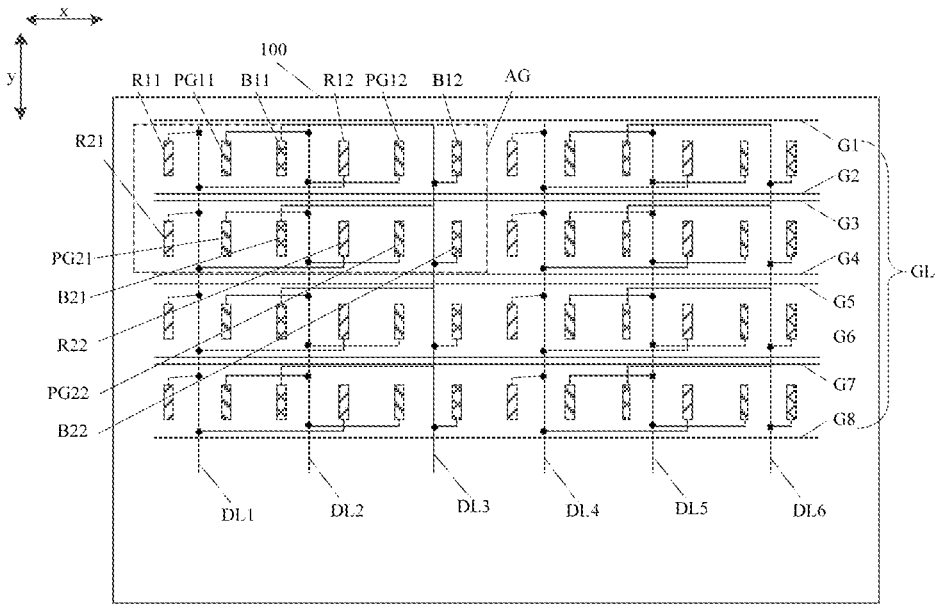
FIG. 2A is a pixel distribution diagram of a display panel according to some embodiments of the present disclosure.

In order to perform the above-mentioned display in the first image display mode and the second image display mode, a structure of the display panel and a method for driving the display panel should be specially designed. A display panel is provided according to the embodiments of the present disclosure. As shown in FIG. 2A, the display panel may include: a plurality of sub-pixels PX arranged in a matrix; and a plurality of data lines DL extending along a first direction (for example, y direction in FIG. 2A) and a plurality of gate lines GL extending along a second direction (for example, x direction in FIG. 2A), and the data lines DL cross the gate lines GL. At least some of the plurality of sub-pixels PX are divided into a plurality of sub-pixel association groups AG. Each sub-pixel association group AG includes a plurality of sub-pixels of a same color electrically connected to a same data line DL. As mentioned above, the display panel has the first image display mode and the second image display mode. In the first image display mode, data writing is performed independently on the plurality of sub-pixels of the same color in the sub-pixel association group AG; and in the second image display mode, data writing is performed synchronously on the plurality of sub-pixels of the same color that are electrically connected to the same data line in each sub-pixel association group AG.

The detailed description will be given below with reference to the specific example of FIG. 2A. In the display panel 100 shown in FIG. 2A, there are sub-pixels of three colors, that is, red (R) sub-pixels, green (G) sub-pixels, and blue (B) sub-pixels. The plurality of sub-pixels are arranged in a sub-pixel matrix of M rows and N columns, each row of sub-pixels extends along the second direction, and each column of sub-pixels extends along the first direction. 12 sub-pixels in an upper-left corner in FIG. 2A constitute a sub-pixel association group AG. The sub-pixel association group AG includes four red sub-pixels (i.e., a first red sub-pixel R11, a second red sub-pixel R12, a third red sub-pixel R21, and a fourth red sub-pixel R22), four green sub-pixels (i.e., a first green sub-pixel PG11, a second green sub-pixel PG12, a third green sub-pixel PG21, and a fourth green sub-pixel PG22) and four blue sub-pixels (i.e., a first blue sub-pixel B11, a second blue sub-pixel B12, a third blue sub-pixel B21, a fourth blue sub-pixel B22). The first red sub-pixel R11, the first green sub-pixel PG11, the first blue sub-pixel B11, the second red sub-pixel R12, the second green sub-pixel PG12, and the second blue sub-pixel B12 are located in a first row of the sub-pixel matrix; the third red sub-pixel R21, the third green sub-pixel PG21, the third blue sub-pixel B21, the fourth red sub-pixel R22, the fourth green sub-pixel PG22, and the fourth blue sub-pixel B22 are located in a second row of the sub-pixel matrix. In the high resolution mode (such as the first image display mode), each sub-pixel in the sub-pixel association group AG is displayed as an independent sub-pixel; while in the low-resolution mode (such as the second image display mode), the sub-pixels of the same color in the sub-pixel association group AG will be displayed as the same sub-pixel. In fact, in the low-resolution mode, the sub-pixel association group AG may be regarded as having only one red sub-pixel, one green sub-pixel and one blue sub-pixel. In some embodiments, each of the at least one data line DL is electrically connected to more than one sub-pixel of the same color in the same row of the sub-pixel matrix.

In the display panel shown in FIG. 2A, each row of sub-pixels corresponds to two gate lines, for example, the first row of sub-pixels corresponds to a first gate line G1 (located above the first row of sub-pixels in the drawing) and a second gate line G2 (located below the first row of sub-pixels in the drawing), the first gate line G1 is connected to odd-numbered sub-pixels in the first row of sub-pixels, and the second gate line G2 is connected to even-numbered sub-pixels in the first row of sub-pixels. Similarly, in FIG. 2A, the second row of sub-pixels corresponds to a third gate line G3 (located above the second row of sub-pixels in the drawing) and a fourth gate line G4 (located below the second row of sub-pixels in the drawing), the third gate line G3 is connected to the odd-numbered sub-pixels in the second row of sub-pixels, and the fourth gate line G4 is connected to the even-numbered sub-pixels in the second row of sub-pixels; a third row of sub-pixels corresponds to a fifth gate line G5 (located above the third row of sub-pixels in the drawing) and a sixth gate line G6 (located below the third row of sub-pixels in the drawing), the fifth gate line G5 is connected to the odd-numbered sub-pixels in the third row of sub-pixels, and the sixth gate line G6 is connected to the even-numbered sub-pixels in the third row of sub-pixels; a fourth row of sub-pixels corresponds to a seventh gate line G7 (located above the fourth row of sub-pixels in the drawing) and a eighth gate line G8 (located below the fourth row of sub-pixels in the drawing), the seventh gate line G7 is connected to the odd-numbered sub-pixels in the fourth row of sub-pixels, and the eighth gate line G8 is connected to the even-numbered sub-pixels in the fourth row of sub-pixels. On the other hand, in the example of FIG. 2A, a same data line DL is connected to two sub-pixels in a row of sub-pixels. Therefore, compared with the case where the same data line DL is connected to only one sub-pixel in a row of sub-pixels, a total number of data lines may be reduced by half, thereby reducing a space required for wiring layout on the display panel. Assuming that the 16K resolution (15360×8640 pixels (each pixel includes red, green, and blue sub-pixels)) is to be achieved in the first image display mode, a total of 7680×3=23040 data lines are required, and a total of 17,280 gate lines are required.

Figure 2B:
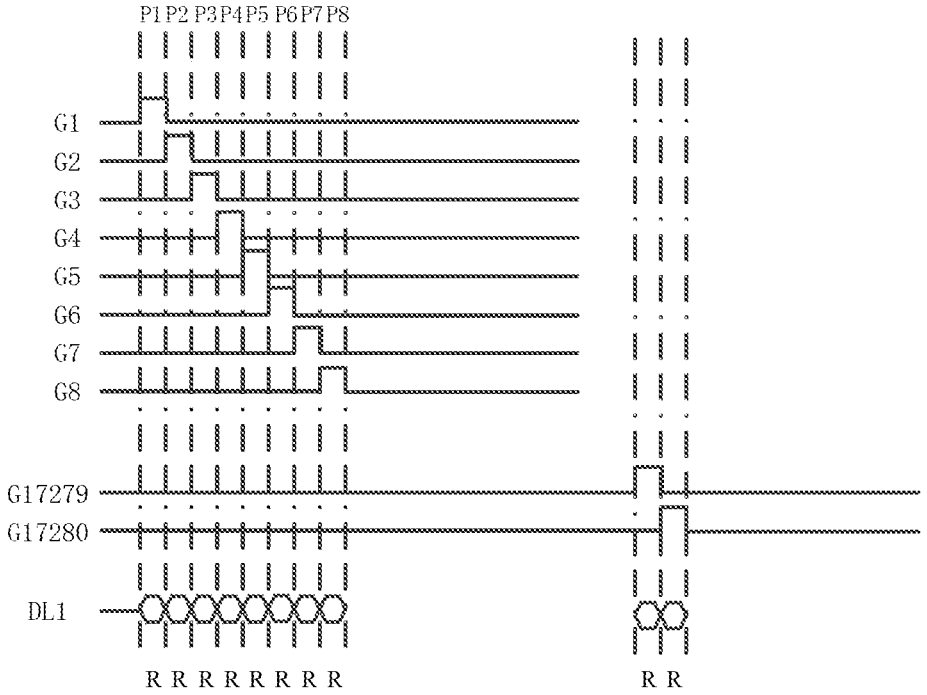
FIG. 2B is a schematic timing diagram of the display panel shown in FIG. 2A in a first image display mode.

FIG. 2B shows an example of a timing diagram corresponding to the sub-pixel arrangement shown in FIG. 2A in the first image display mode. The timing of the pulses loaded on the first gate line G1 to the eighth gate line G8 is shown in FIG. 2B. The image resolution is high in the first image display mode. Thus, in the first image display mode, each gate line (for example, the first gate line G1 to the eighth gate line G8, . . . , the last few gate lines G17279, G17280) are loaded with a pulse to trigger each sub-pixel in the same row in sequence, so that each sub-pixel may have an independent display function to ensure the high resolution. A pulse width loaded on the gate line depends on the refresh rate to be achieved. For example, if the refresh rate is 30 Hz in the first image display mode, the aforementioned pulse width may be 1.8 microseconds. Along with the pulses loaded on the first gate line G1 to the eighth gate line G8, the data line (for example, the data line DL1 shown in FIG. 2A) is sequentially loaded with data signals corresponding to the red sub-pixels. Since the data line DL1 is connected with the two red sub-pixels in each row of sub-pixels, data of every two periods in the data signal in FIG. 2B corresponds to one row of sub-pixels.

Figure 2C:
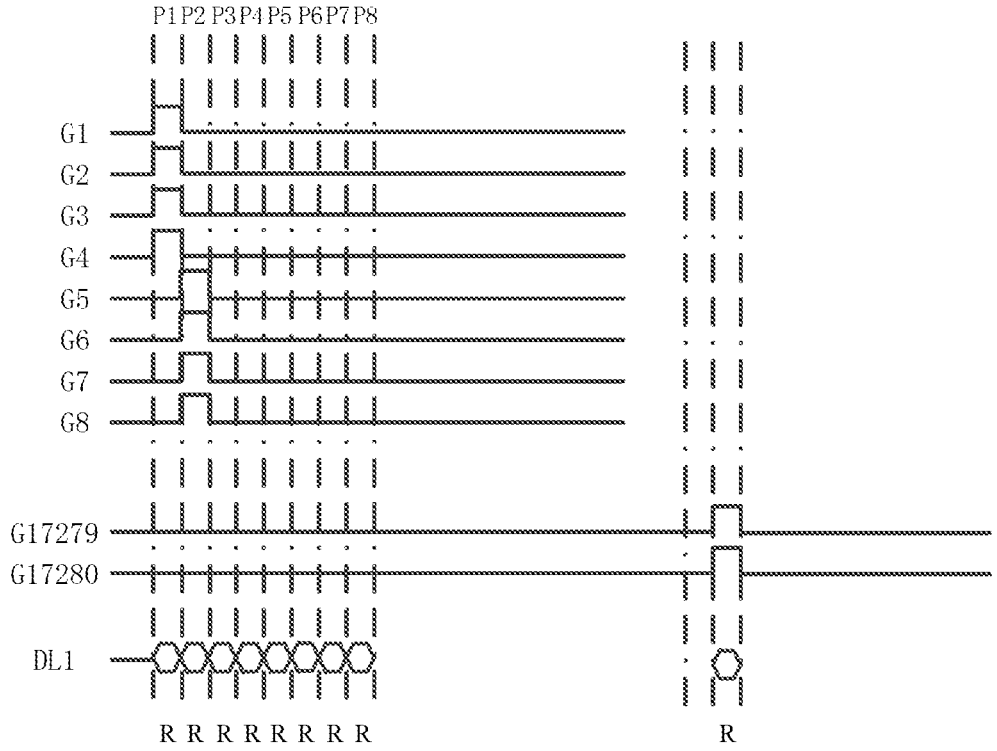
FIG. 2C is a schematic timing diagram of the display panel shown in FIG. 2A in a second image display mode.

FIG. 2C shows an example of a timing diagram corresponding to the sub-pixel arrangement shown in FIG. 2A in the second image display mode. In the second image display mode, the pulses loaded on every four gate lines are synchronized. Accordingly, the data signal on the data line DL1 is consistent for the four red sub-pixels in the same sub-pixel association group AG. Specifically, in a first time period P1, the first gate line G1 to the fourth gate line G4 are all loaded with the pulses, in a second time period P2, the fifth gate line G5 to the eighth gate line G8 are loaded with the pulses, . . . , until the last few gate lines G17279 and G17280 are loaded with the pulses. In the first time period P1, the data line DL1 is loaded with the data signal for the first red sub-pixel R11, the second red sub-pixel R12, the third red sub-pixel R21, and the fourth red sub-pixel R22. The following analogy will not be repeated. Assuming that in the second image display mode, the image resolution is 8K (that is, 7680×8640 pixels (each pixel includes red, green, and blue sub-pixels)) and the refresh rate is 120 Hz, then the width of the pulse loaded on the gate line is still 1.8 microseconds.

Although the red sub-pixels are taken as an example for description, it should be understood that the above-mentioned embodiment may be extended to sub-pixels of other colors.

In some embodiments, each sub-pixel association group AG includes sub-pixels located in the plurality of rows of the sub-pixel matrix, and in the first image display mode, more than one gate line respectively electrically connected to the plurality of sub-pixels of the same color in each sub-pixel association group AG are scanned independently. In the second image display mode, more than one gate line respectively electrically connected to the plurality of sub-pixels of the same color in each sub-pixel association group are scanned synchronously.

Figure 3A:
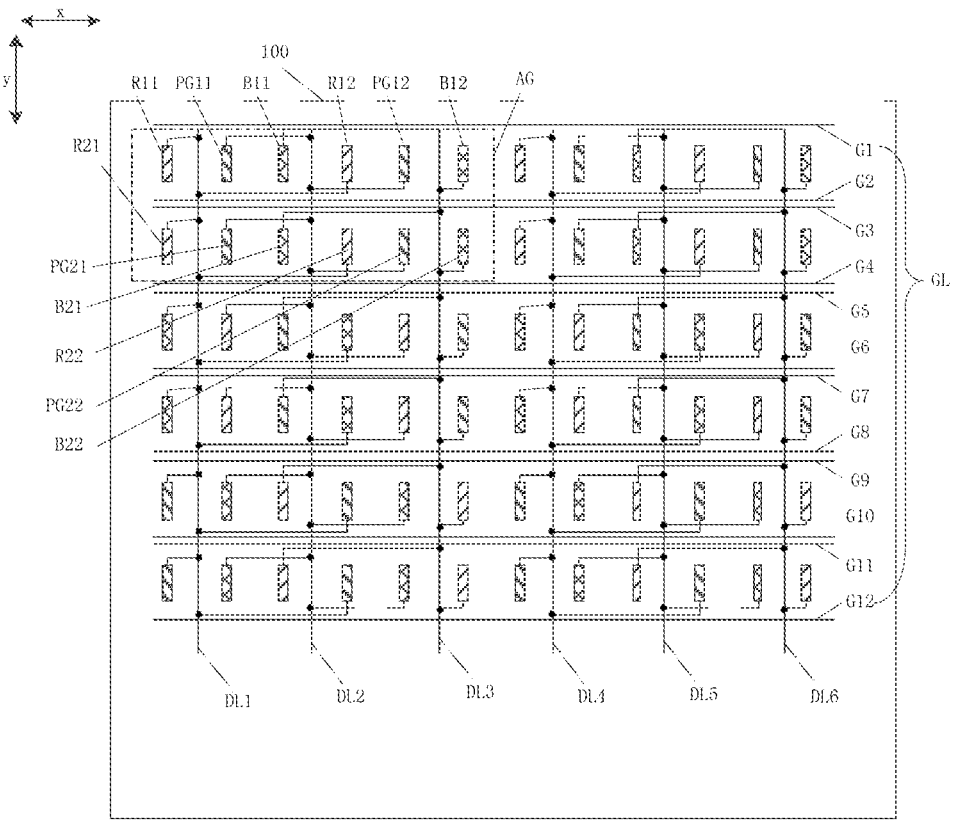
FIG. 3A is a pixel distribution diagram of a display panel according to other embodiments of the present disclosure.

In some embodiments, as shown in FIG. 2A, the sub-pixels arranged in the same column of the sub-pixel matrix have the same color. In other embodiments, the sub-pixels of different colors are periodically arranged in the same column of the sub-pixel matrix. For example, as shown in FIG. 3A, in the first column of sub-pixels, the sub-pixel in the first row and the sub-pixel in the second row are red sub-pixels, the sub-pixel in the third and fourth rows are blue sub-pixels, and the sub-pixel in the fifth row and the sub-pixel in the sixth row are green sub-pixels, which are arranged periodically in sequence. Similarly, in the second column of sub-pixels, the sub-pixel in the first row and the sub-pixel in the second row are green sub-pixels, the sub-pixel in the third row and the sub-pixel in the fourth row are red sub-pixels, and the sub-pixel in the fifth row and the sub-pixel in the sixth row are blue sub-pixels, the sub-pixels of different colors are arranged periodically in sequence. In the third column of sub-pixels, the sub-pixel in the first row and the sub-pixel in the second row are blue sub-pixels, the sub-pixel in the third row and the sub-pixel in the fourth row are green sub-pixels, and the sub-pixel in the fifth row and the sub-pixel in the sixth row are red sub-pixels, which are arranged periodically in sequence.

Figure 3B:
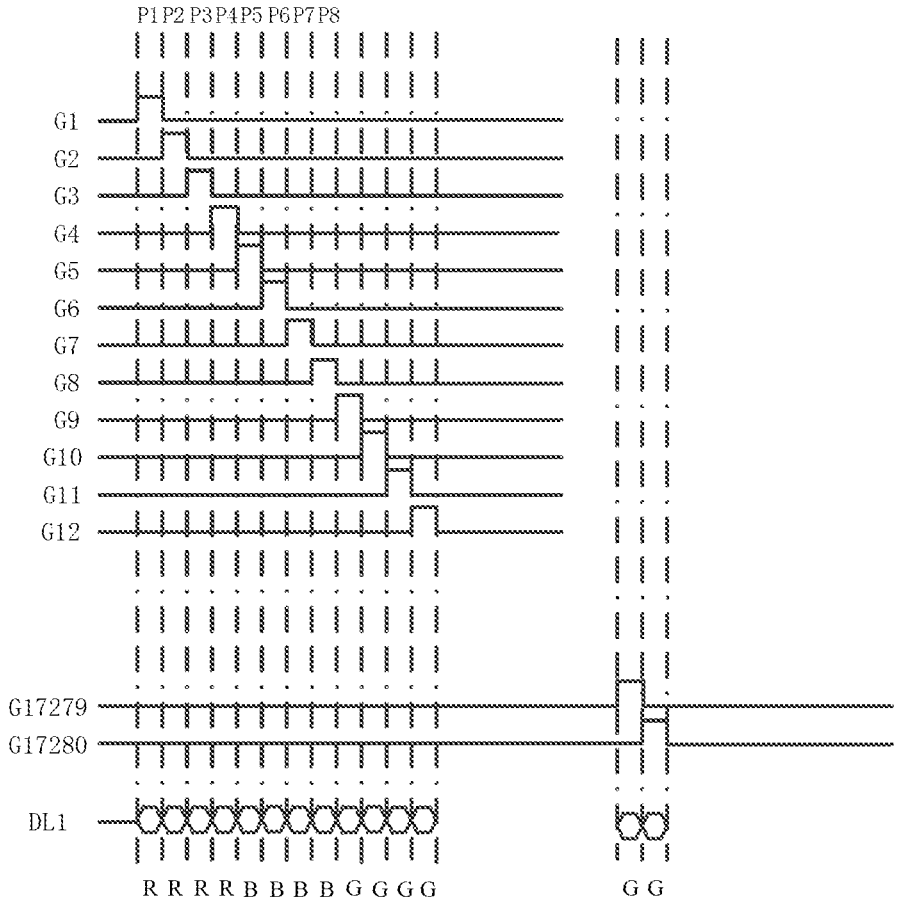
FIG. 3B is a schematic timing diagram of the display panel shown in FIG. 3A in the first image display mode.
Figure 3C:
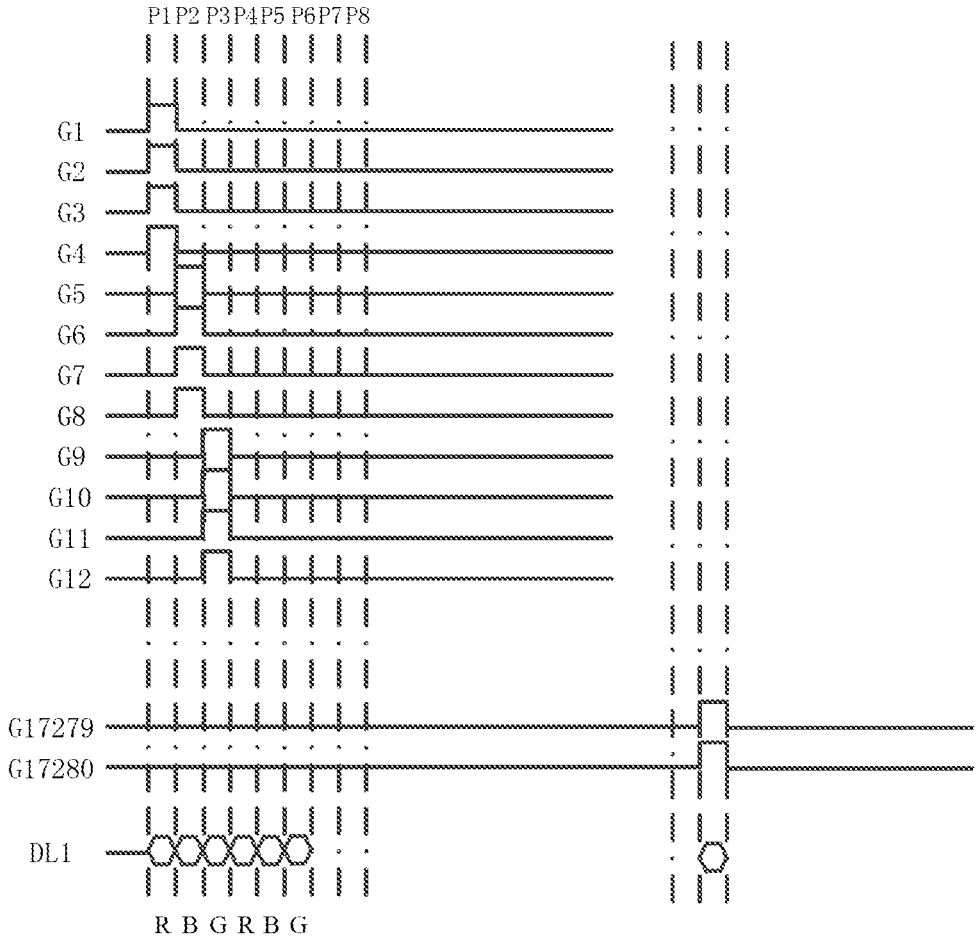
FIG. 3C is a schematic timing diagram of the display panel shown in FIG. 3A in the second image display mode.

Compared with the solution in which sub-pixels arranged in the same column have the same color, as shown in FIG. 2A, the solution in which sub-pixels of different colors are periodically arranged in the same column of the sub-pixel matrix is more conducive to color balance and image quality improvement. FIG. 3B shows an example of a timing diagram corresponding to the sub-pixel arrangement shown in FIG. 3A in the first image display mode. FIG. 3C shows an example of a timing diagram corresponding to the sub-pixel arrangement shown in FIG. 3A in the second image display mode. By comparing FIGS. 3B and 3C with FIGS. 2B and 2C, it may be seen that the method for driving the display panel shown in FIG. 3A is similar to the method for driving the display panel shown in FIG. 2A, the difference is only that the same data is loaded with data signals corresponding to the sub-pixels of different colors. This is because in the embodiment shown in FIG. 3A, sub-pixels of different colors are included in the same column of sub-pixels, therefore, the same data line also needs to be connected to sub-pixels of different colors. In the second image display mode, the sub-pixels of the same color in the same sub-pixel association group AG are turned on and off together to be used as the same sub-pixel. In order to show the arrangement of the sub-pixels more completely, in FIGS. 3A, 3B, and 3C, 12 gate lines are shown, that is, the first gate line G1, the second gate line G2, the third gate line G3, the fourth gate line G4, the fifth gate line G5, the sixth gate line G6, the seventh gate line G7, the eighth gate line G8, a ninth gate line G9, a tenth gate line G10, an eleventh gate line G11, and a twelfth gate line G12.

In the above embodiment, the same data line may be directly electrically connected to more than one sub-pixels of the same color in the same row of the sub-pixel matrix. However, in some embodiments, the same data line may also be electrically connected to more than one sub-pixel of the same color in the same row of the sub-pixel matrix through a switch element.

Figure 4A:
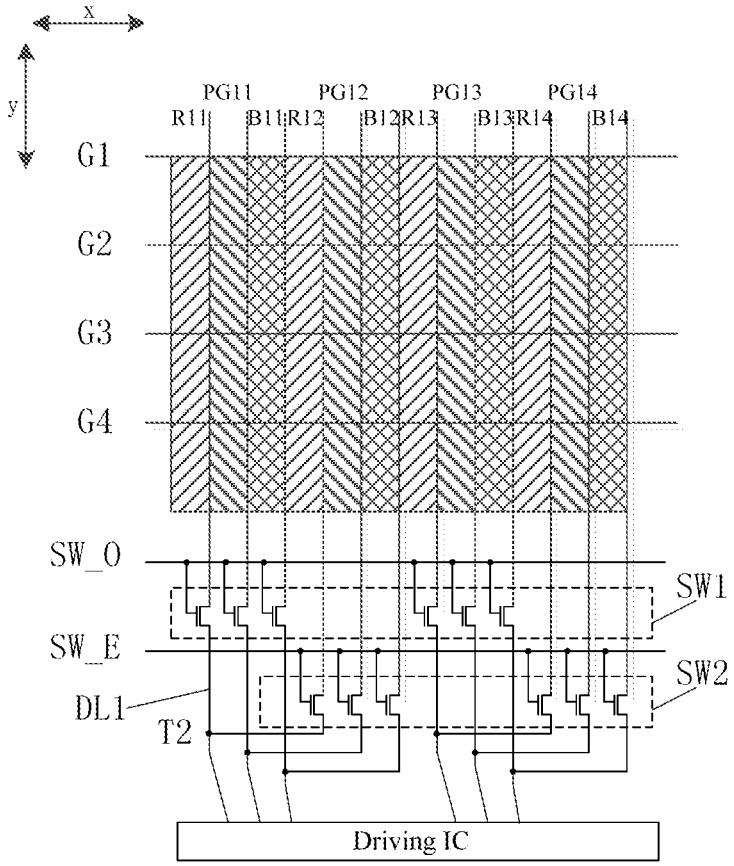
FIG. 4A is a pixel distribution diagram of a display panel according to other embodiments of the present disclosure.

FIG. 4A is a pixel distribution diagram of a display panel according to other embodiments of the present disclosure. In the example shown in FIG. 4A, each row of sub-pixels corresponds to only one gate line. For example, a first row of sub-pixels corresponds to a first gate line G1, a second row of sub-pixels corresponds to a second gate line G2, a third row of sub-pixels corresponds to a third gate line G3, and a fourth row of sub-pixels corresponds to a fourth gate line G4. Each column of sub-pixels also corresponds to only one data line DL. A plurality of sub-pixels are arranged in a sub-pixel matrix of M rows and N columns, and the plurality of sub-pixels include sub-pixels of a plurality of colors (for example, red sub-pixels, green sub-pixels and blue sub-pixels), and colors of the sub-pixels arranged in a same column of the sub-pixel matrix are the same, and the sub-pixels of different colors are periodically arranged one by one in a same row of the sub-pixel matrix, each row of sub-pixels extends along a second direction (for example, x direction in FIG. 4A), each column of sub-pixels extends along a first direction (for example, y direction in FIG. 4A). The display panel further includes a first group of switches SW1 and a second group of switches SW2, and the number of color types of the sub-pixels is G (G is 3 in the example of FIG. 4A). A data line connected to a $2nG+i_{th}$ column of sub-pixels is connected to a second node through a $nG+i_{th}$ switch in the first group of switches SW1, and a data line connected to a $(2n+1)G+i_{th}$ column of sub-pixel is connected to the node T2 through a $(n+1)\ G+i_{th}$ switch in the second group of switches SW2. n is an integer greater than or equal to zero and less than or equal to (N/2G), and i is an integer greater than or equal to 1 and less than or equal to G. The node T2 may be connected with a driving IC (integrated circuit) on the display panel. In the first image display mode, driving pulses are sequentially applied to the first gate line G1, the second gate line G2, the third gate line G3, and the fourth gate line G4, and the first group of switches SW1 and the second group of switches SW2 are alternately applied with pulses, so that the sub-pixels in each row of sub-pixels are sequentially lit one by one to ensure the resolution of the image display. In the second image display mode, the first group of switches SW1 and the second group of switches SW2 are always kept on, so that the sub-pixels in the $2nG+i_{th}$ column and the $(2n+1)G+i_{th}$ column are lit synchronized.

Figure 4B:
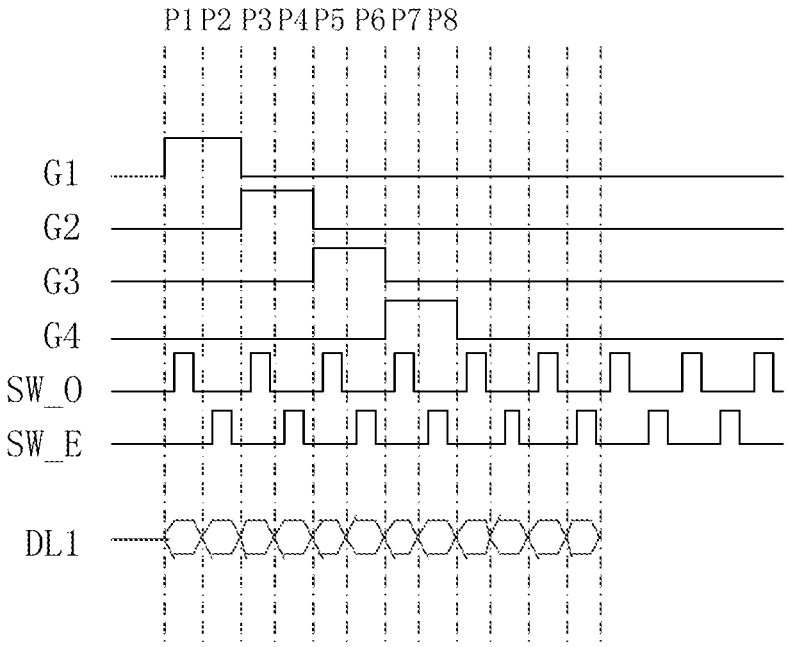
FIG. 4B is a schematic timing diagram of the display panel shown in FIG. 4A in a first image display mode.
Figure 4C:
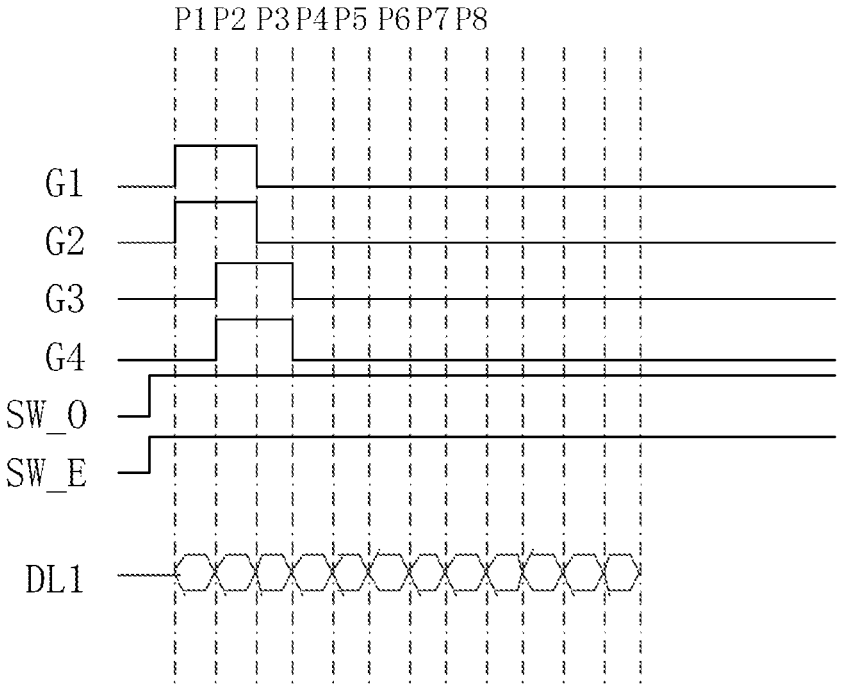
FIG. 4C is a schematic timing diagram of the display panel shown in FIG. 4A in a second image display mode.

FIG. 4B is a schematic timing diagram of the display panel shown in FIG. 4A in the first image display mode (similar to the example shown in FIG. 2B, which is also used to achieve 16K resolution and 30 Hz refresh rate). As shown in FIG. 4B, in the first image display mode, the first gate line scans and turns on the first row of sub-pixels in a first time period P1 and a second time period P2, and the second gate line scans and turns on the second row of sub-pixels in a third time period P3 and a fourth time period P4, the third gate line scans and turns on the third row of sub-pixels in a fifth time period P5 and a sixth time period P6, and the fourth gate line scans and turns on the fourth row of sub-pixels in the seventh time period P7 and the eighth period P8, the first group of switches SW1 are turned on during the first time period P1, the third time period P3, the fifth time period P5, and the seventh time period P7, and are turned off during the second time period P2, the fourth time period P4, the sixth time period P6, and the eighth time period P8. The second group of switches SW2 are turned on during the second time period P2, the fourth time period P4, the sixth time period P6, and the eighth time period P8, and are turned off during the first time period P1, the third time period P3, the fifth time period P5, and the seventh time period P7. A signal SW_O in FIGS. 4A, 4B, and 4C is a control signal for controlling the first group of switches. In this example, when the signal SW_O is at a high level, the first group of switches SW1 will be turned on; when the signal SW_O is at a low level, the first group of switches SW1 will be turned off. Similarly, in this example, when a signal SW_E is at a high level, the second group of switches SW2 will be turned on; when the signal SW_E is at a low level, the second group of switches SW2 will be turned off. However, the embodiments of the present disclosure are not limited to this. For example, the first group of switches SW1 may also be set to be turned off when the signal SW_O is at the high level and turned on when the signal SW_O is at the low level, or the second group of switches SW2 may also be set to be turned off when the signal SW_E is at the high level and turn on when the signal SW_E is at the low level.

FIG. 4C is a schematic timing diagram of the display panel shown in FIG. 4A in the second image display mode (similar to the example shown in FIG. 2C, which is also used to achieve 8K resolution and 120 Hz refresh rate). As shown in FIG. 4C, in the second image display mode, the first gate line and the second gate line scan and turn on the first row of sub-pixels and the second row of sub-pixels during the first period P1 and the second period P2, the third gate line and the fourth gate line scan and turn on the third row of sub-pixels and the fourth row of sub-pixels in the second period P2 and the third period P3. The first group of switching switches SW1 and the second group of switching switches SW2 are kept on during the first time period P1, the second time period P2, the third time period P3, and the fourth time period P4. In the example shown in FIG. 4C, in the first time period P1, the second time period P2, the third time period P3, and the fourth time period P4, the signal SW_E and the signal SW_O are always at the high level. In this way, the sub-pixels of the same color in the same sub-pixel association group AG will be displayed as the same sub-pixel. It should be noted that in the example of FIG. 4C, the pulses on the first gate line G1 and the second gate line G2 and the pulses on the third gate line G3 and the fourth gate line G4 overlap in time. In the second time period P2, the pulses on the third gate line G3 and the fourth gate line G4 are used to pre-charge a storage capacitor, so the third row of sub-pixels and the fourth row of sub-pixels are actually turned on in the third time period P3.

Figure 5A:
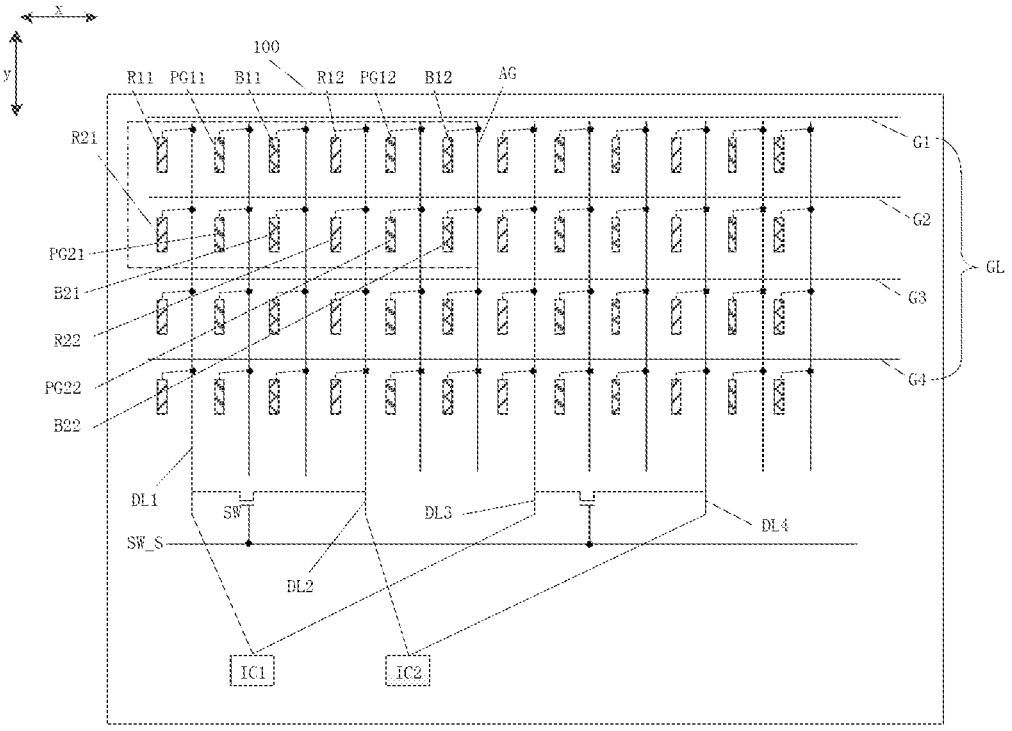
FIG. 5A is a pixel distribution diagram of a display panel according to other embodiments of the present disclosure.

FIG. 5A is a pixel distribution diagram of a display panel according to other embodiments of the present disclosure. In this example, each row of sub-pixels corresponds to only one gate line. For example, a first row of sub-pixels corresponds to a first gate line G1, a second row of sub-pixels corresponds to a second gate line G2, a third row of sub-pixels corresponds to a third gate line G3, and a fourth row of sub-pixels corresponds to a fourth gate line G4. Each column of sub-pixels also corresponds to only one data line DL. A plurality of sub-pixels are arranged in a sub-pixel matrix of M rows and N columns, and the plurality of sub-pixels include sub-pixels of a plurality of colors (for example, red sub-pixels, green sub-pixels and blue sub-pixels), and an arrangement of the sub-pixels is the same as the arrangement in the example shown in FIG. 4A. Colors of the sub-pixels arranged in a same column of the sub-pixel matrix are the same, and the sub-pixels of different colors are periodically arranged one by one in a same row of the sub-pixel matrix, and each row of sub-pixels extends along a second direction (for example, x direction in FIG. 5A), each column of sub-pixels extends along a first direction (for example, y direction in FIG. 5A). The sub-pixels of the same color in a same sub-pixel association group AG are each connected to a corresponding data line, but adjacent data lines corresponding to the sub-pixels of the same color in the same sub-pixel association group AG are connected through a switch SW. The switch SW is turned on or turned off by a control signal SW_S on a control terminal of the switch. In the first image display mode, the switch SW is turned off, and each sub-pixel in the same sub-pixel association group AG is displayed independently, while in the second image display mode, the switch SW is turned on, and the sub-pixels of the same color in the same sub-pixel association group AG are displayed together. In some embodiments, for ease of manipulation, different integrated circuits may be used to control signals on the data lines corresponding to odd-numbered columns of sub-pixels and even-numbered columns of sub-pixels. For example, in the example of FIG. 5A, the signals on the data lines DL1 and DL3 corresponding to the odd-numbered sub-pixels are provided by a first integrated circuit IC1, and the signals on the data lines DL2 and DL4 corresponding to the even-numbered sub-pixels are provided by a second integrated circuit IC2. In this way, in the first image display mode, the switch SW is turned off, and the first integrated circuit IC1 and the second integrated circuit IC2 are used to respectively provide signals on the data lines corresponding to the odd-numbered columns of sub-pixels and the even-numbered columns of sub-pixels; and in the second image display mode, the switch SW is turned on, so that only one of the first integrated circuit IC1 and the second integrated circuit IC2 may be turned on and the other may be turned off (for example, the first integrated circuit IC1 is turned on and the second integrated circuit IC2, vice versa). This is conducive to providing a driving capability of a system. However, the embodiments of the present disclosure are not limited to this. For example, the signals on the data lines corresponding to the odd-numbered columns of sub-pixels and the even-numbered columns of sub-pixels may also be provided by a same integrated circuit.

Figure 5B:
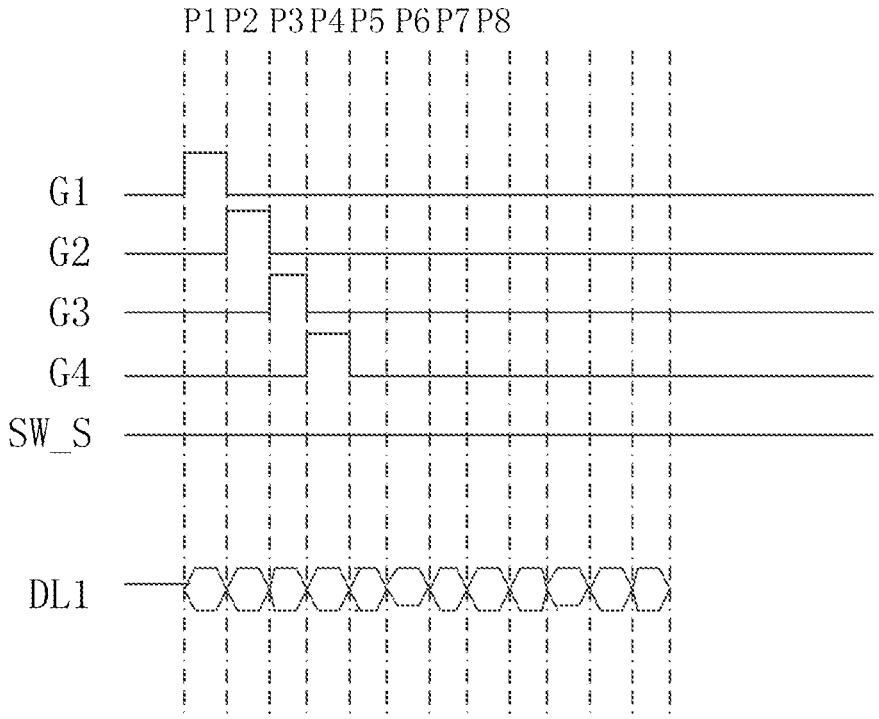
FIG. 5B is a schematic timing diagram of the display panel shown in FIG. 5A in a first image display mode.

FIG. 5B is a schematic timing diagram of the display panel shown in FIG. 5A in the first image display mode. It may be seen that the first gate line G1 scans and turns on the first row of sub-pixels in a first time period P1, the second gate line G2 scans and turns on the second row of sub-pixels in a second time period P2, the third gate line G3 scans and turns on the third row of sub-pixels in a third period P3, and the fourth gate line G4 scans and turns on the fourth row of sub-pixels in a fourth period P4. That is, pulses are applied to the first gate line G1, the second gate line G2, the third gate line G3, and the fourth gate line G4 in the first time period P1, the second time period P2, the third time period P3, and the fourth time period P4 in sequence, respectively. In the first image display mode, the control signal SW_S of the switch element SW is always at a low level, and the switch SW is turned off. Each data line sends data independently. Each sub-pixel performs display operations independently.

Figure 5C:
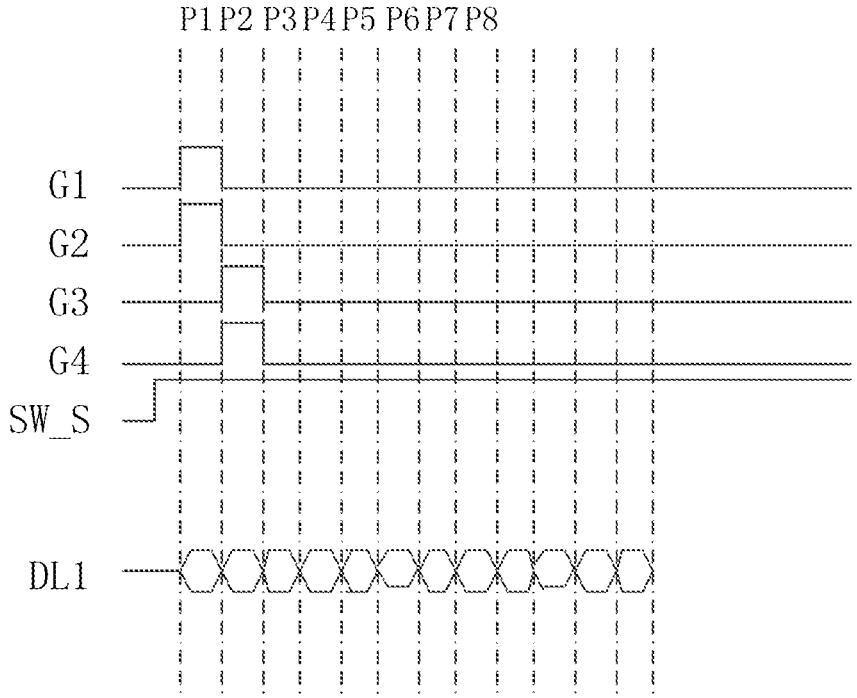
FIG. 5C is a schematic timing diagram of the display panel shown in FIG. 5A in a second image display mode.

FIG. 5C is a schematic timing diagram of the display panel shown in FIG. 5A in the second image display mode. As shown in FIG. 5C, in the second image display mode, the first gate line G1 and the second gate line G2 scan and turn on the first row of sub-pixels and the second row of sub-pixels in the first time period P1, the third gate line G3 and the fourth gate line G4 scan and turn on the third row of sub-pixels and the fourth row of sub-pixels in the second period P2. The control signal SW_S of the switch SW is always at a high level, and the switch SW is turned on. At this time, only one of the two data lines connected by the switch SW need to loaded with data (for example, an odd-numbered column data line or an even-numbered column data line). In this way, the sub-pixels of the same color in the same sub-pixel association group AG will be displayed as the same sub-pixel, thereby saving system resources.

In some embodiments, as shown in FIG. 5A, the plurality of sub-pixels on the display panel include a first color sub-pixel PR, a second color sub-pixel PG, and a third color sub-pixel PB, and the plurality of data lines on the display panel include a first data line DL1, a second data line DL2, and a third data line DL3. Each sub-pixel association group AG includes a plurality of first color sub-pixels PR electrically connected to the first data line DL1, a plurality of second color sub-pixels PG electrically connected to the second data line DL2 and a plurality of third color sub-pixels PB electrically connected to the third data line DL3.

Figure 6A:
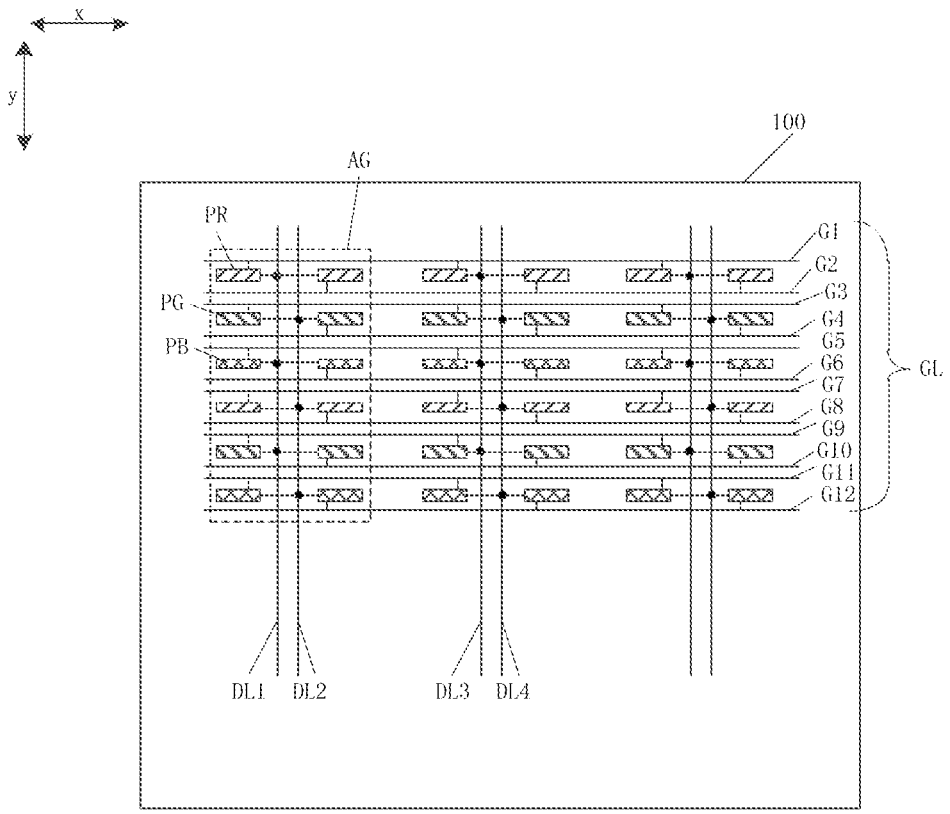
FIG. 6A is a pixel distribution diagram of a display panel according to other embodiments of the present disclosure.

FIG. 6A is a pixel distribution diagram of a display panel according to other embodiments of the present disclosure. In the example shown in FIG. 6A, colors of sub-pixels arranged in a same row in a sub-pixel matrix are the same, and each sub-pixel association group AG includes a plurality of first color sub-pixels PR in a first row of the sub-pixel matrix that are electrically connected to a first data line DL1, a plurality of second color sub-pixels PG in a second row of the sub-pixel matrix that are electrically connected to a second data line DL2, a plurality of third color sub-pixels PB in a third row of the sub-pixel matrix that are electrically connected to the first data line DL1, a plurality of first color sub-pixels PR in a fourth row of the sub-pixel matrix that are electrically connected to the second data line DL2, a plurality of second color sub-pixels PG in a fifth row of the sub-pixel matrix that are electrically connected to the first data line DL1, a plurality of third color sub-pixels PB in a sixth row of the sub-pixel matrix that are electrically connected to the second data line DL2.

In the example shown in FIG. 6A, a first gate line G1, a second gate line G2, a third gate line G3, a fourth gate line G4, a fifth gate line G5, a sixth gate line G6, a seventh gate line G7, an eighth gate line G8, a ninth gate line G9, a tenth gate line G10, an eleventh gate line G11, and a twelfth gate line G12 are provided on a display panel. The first gate line G1 is electrically connected to odd-numbered first color sub-pixels PR in the first row of the sub-pixel matrix, the second gate line G2 is electrically connected to even-numbered first color sub-pixels PR in the first row of the sub-pixel matrix, the third gate line G3 is electrically connected to odd-numbered second color sub-pixels PG in the second row of the sub-pixel matrix, and the fourth gate line G4 is electrically connected to even-numbered second color sub-pixels PG in the second row of the sub-pixel matrix, the fifth gate line G5 is electrically connected to odd-numbered third color sub-pixels PB in the third row of the sub-pixel matrix, and the sixth gate line G6 is electrically connected to even-numbered third color sub-pixels PB in the third row of the sub-pixel matrix, the seventh gate line G7 is electrically connected to odd-numbered first color sub-pixels PR in the fourth row of the sub-pixel matrix, and the eighth gate line G8 is electrically connected to even-numbered first color sub-pixel PR in the fourth row of the sub-pixel matrix, the ninth gate line G9 is electrically connected to odd-numbered second color sub-pixels PG in the fifth row of the sub-pixel matrix, the tenth gate line G10 is electrically connected to even-numbered second color sub-pixels PG in the fifth row of the sub-pixel matrix, the eleventh gate line G11 is electrically connected to odd-numbered third color sub-pixels PB in the sixth row of the sub-pixel matrix, and the twelfth gate line G12 is electrically connected to even-numbered third color sub-pixels PB in the sixth row of the sub-pixel matrix. In the example shown in FIG. 6A, a total of twelve sub-pixels in the first six rows in two leftmost columns constitute a sub-pixel association group AG. The sub-pixels of the same color in the sub-pixel association group AG are displayed synchronously in the second image display mode, and may be regarded as the same sub-pixel. Taking the first color (for example, red) sub-pixels in the sub-pixel association group AG as an example, the two first color sub-pixels PR in the first row of the sub-pixel association group AG are respectively controlled by the first gate line G1 and the second gate line G2, and the two first color sub-pixels PR in the fourth row are respectively controlled by the seventh gate line G7 and the eighth gate line G8. Therefore, in the second image display mode, by controlling the signals on the first gate line G1, the second gate line G2, the seventh gate line G7, and the eighth gate line G8 synchronously, it is possible that the four first color sub-pixels in the sub-pixel association group AG are displayed together to achieve effects of reducing the resolution and increasing the refresh rate. The second color sub-pixels PG and the third color sub-pixels PB in the sub-pixel association group AG may also be controlled in a similar manner. Specifically, the two second color sub-pixels PG in the second row of the sub-pixel association group AG are respectively controlled by the third gate line G3 and the fourth gate line G4, and the two second color sub-pixels PG in the fifth row are respectively controlled by the ninth gate line G9 and the tenth gate line G10. In the second image display mode, by controlling the third gate line G3, the fourth gate line G4, the ninth gate line G9, and the tenth gate line G10 synchronously, it is possible that the four second color sub-pixels in the association group AG are displayed together. Similarly, the two third color sub-pixels PB in the third row of the sub-pixel association group AG are respectively controlled by the fifth gate line G5 and the sixth gate line G6, and the two third color sub-pixels PB in the sixth row are respectively controlled by the eleventh gate line G11 and the twelfth gate line G12. In the second image display mode, by controlling the fifth gate line G5, the sixth gate line G6, the eleventh gate line G11, and the twelfth gate line G12 synchronously, it is possible that the four third color sub-pixels PB in the sub-pixel association group AG are displayed together. The arrangement of sub-pixels as shown in FIG. 6A is beneficial to reduce the number of data lines, thereby reducing a wiring difficulty of a bonding area in the display panel.

Figure 6B:
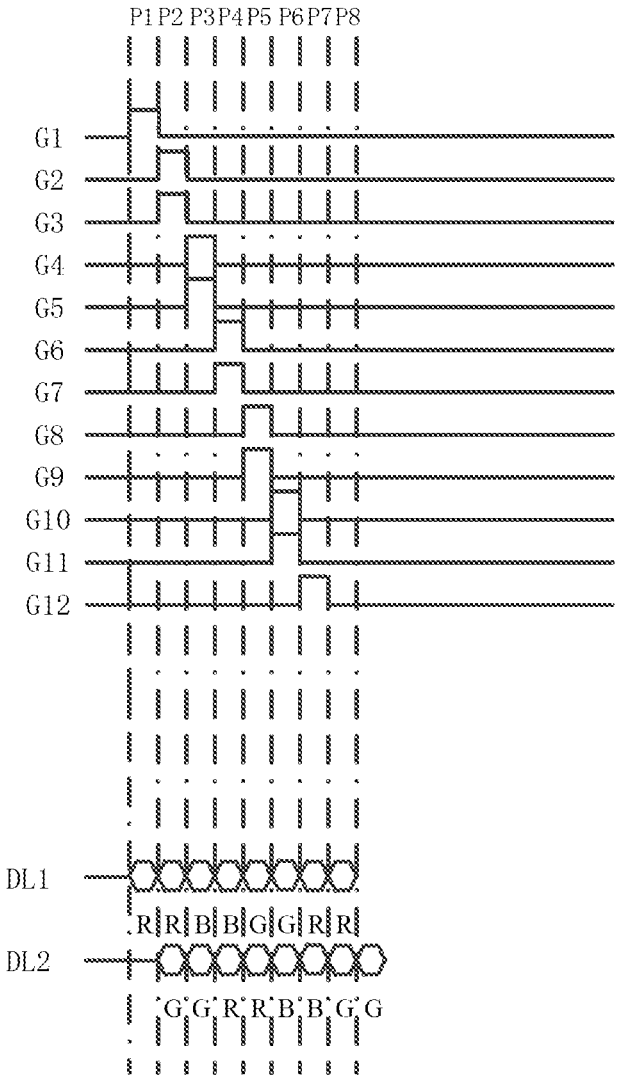
FIG. 6B is a schematic timing diagram of the display panel shown in FIG. 6A in a first image display mode.

FIG. 6B is a schematic timing diagram of the display panel shown in FIG. 6A in the first image display mode. As shown in FIG. 6B, in the first image display mode, the first gate line G1 scans in a first period P1, the second gate line G2 and the third gate line G3 scan in a second period P2, the fourth gate line G4 and the fifth gate line G5 scan in a third period P3, the sixth gate line G6 and the seventh gate line G7 scan in a fourth period P4, the eighth gate line G8 and the ninth gate line G9 scan in a fifth period P5, the tenth gate line G10 and the eleventh gate line G11 scan in a sixth period P6, and the twelfth gate line G12 scans in a seventh period P7. It may be seen from FIG. 6B that the sub-pixel association group AG needs two data lines, that is, a first data line DL1 and a second data line DL2, to load data. The first data line DL1 is used to load data for odd-numbered rows of sub-pixels, and the second data line DL2 is used to load data for even-numbered rows of sub-pixels. Similarly, a third data line DL3 is used to load data for the odd-numbered rows of sub-pixels, and a fourth data line DL4 is used to load data for the even-numbered rows of sub-pixels. As shown in FIG. 6B, the first data line DL1 provides data for the first row of sub-pixels (first color sub-pixels), the third row of sub-pixels (third color sub-pixels), and the fifth row of sub-pixels (second color sub-pixels). Specifically, when the first gate line G1 activates the first color sub-pixel in the first row and the first column in the first time period P1, data transmitted on the first data line DL1 is for the first color sub-pixel in the first row and the first column; when the second gate line G2 activates the first color sub-pixel in the first row and the second column during the second time period P2, data transmitted on the first data line DL1 is for the first color sub-pixel in the first row and the second column; when the fifth gate line G5 activates the third color sub-pixel in the third row and the first column in the third time period P3, data transmitted on the first data line DL1 is for the third color sub-pixel in the third row and the first column; when the sixth gate line G6 activates the third color sub-pixel in the third row and second column in the fourth time period P4, data transmitted on the first data line DL1 is for the third color sub-pixel in the third row and the second column; when the ninth gate line G9 activates the second color sub-pixel in the fifth row and the first column in the fifth time period P5, data transmitted on the first data line DL1 is for the second color sub-pixel in the fifth row and first column; when the tenth gate line G10 activates the second color sub-pixel in the fifth row and the second column in the sixth time period P6, data transmitted on the first data line DL1 is for the second color sub-pixels in the fifth row and the second column. Similarly, when the third gate line G3 activates the second color sub-pixel in the second row and the first column in the second time period P2, data transmitted on the second data line DL2 is for the second color sub-pixel in the second row and the first column; when the fourth gate line G4 activates the second color sub-pixel in the second row and the second column during the third time period P3, the data transmitted on the second data line DL2 is for the second color sub-pixel in the second row and the second column; when the seventh gate line G7 activates the first color sub-pixel in the fourth row and the first column in the fourth time period P4, data transmitted on the second data line DL2 is for the first color sub-pixel in the fourth row and the first column; when the eighth gate line G8 activates the first color sub-pixel in the fourth row and the second column in the fifth time period P5, data transmitted on the second data line DL2 is for the first color sub-pixel in the fourth row and the second column; when the eleventh gate line G11 activates the third color sub-pixel in the sixth row and the first column in the sixth period P6, data transmitted on the data line DL2 is data for the third color sub-pixel in the sixth row and the first column; when the twelfth gate line G12 activates the third color sub-pixel in the sixth row and the second column in the seventh time period P7, data transmitted on the second data line DL2 is for the third color sub-pixel in the sixth row and the second column.

Figure 6C:
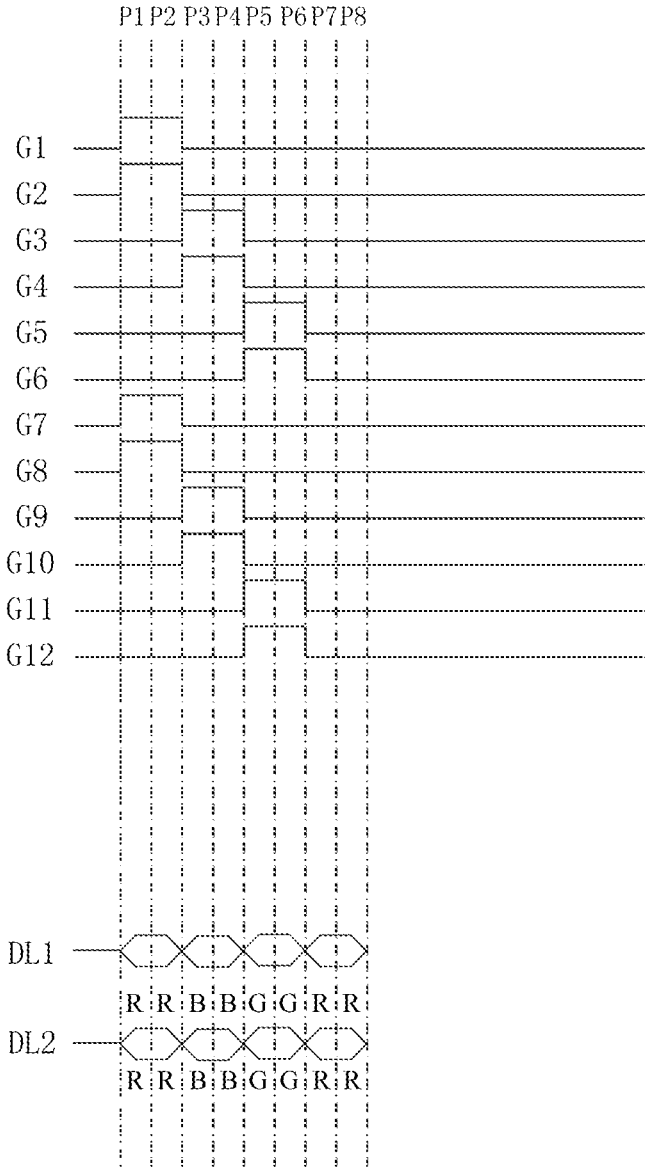
FIG. 6C is a schematic timing diagram of the display panel shown in FIG. 6A in a second image display mode.

FIG. 6C is a schematic timing diagram of the display panel shown in FIG. 6A in the second image display mode. As shown in FIG. 6C, in the second image display mode, the first gate line G1, the second gate line G2, the seventh gate line G7, and the eighth gate line G8 scan in the first time period P1 and the second time period P2. This may control the four first color sub-pixels in the sub-pixel association group AG to display synchronously, and may reduce the display resolution and increase the refresh rate during the display operation. Similarly, in the second image display mode, the third gate line G3, the fourth gate line G4, the ninth gate line G9, and the tenth gate line G10 scan in the third period P3 and the fourth period P4; the fifth gate line G5, the sixth gate line G6, the eleventh gate line G11, and the twelfth gate line G12 scan in the fifth period P5 and the sixth period P6. In this way, the four second color sub-pixels and the four third color sub-pixels in the sub-pixel association group AG may be respectively controlled to be displayed synchronously. As shown in FIG. 6C, the first data line DL1 and the second data line DL2 transmit data for the corresponding sub-pixels according to the timing of each gate line. In some embodiments, time lengths of the first time period P1 to the seventh time period P7 may be equal, for example, all of which are 1.8 microseconds. Of course, the embodiments of the present disclosure are not limited to this, and each of the above-mentioned time periods may also have other time lengths.

Figure 7:
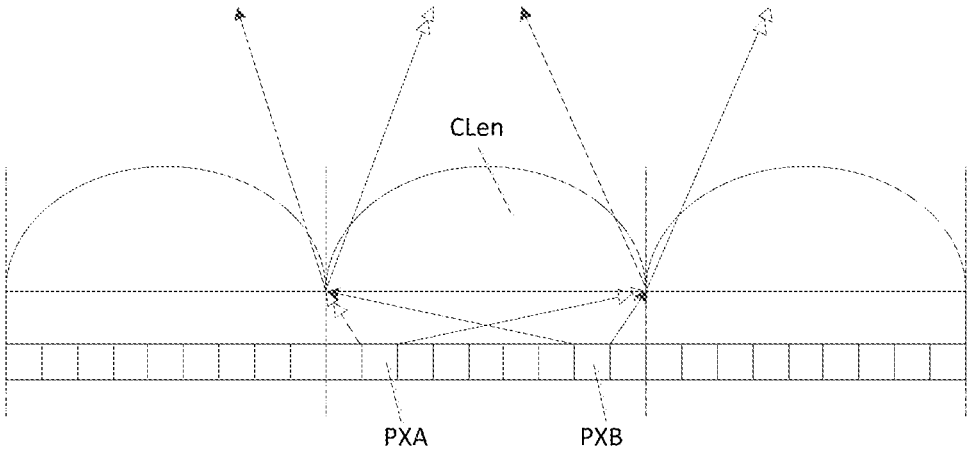
FIG. 7 shows a schematic diagram of a principle of a multi-view three-dimensional display panel.

The embodiments of the present disclosure also provide a multi-view three-dimensional display panel. The multi-view 3D display panel may provide a plurality of viewing angles, and may provide a corresponding image for each viewing angle. These images at different viewing angles may be used to show images of a same object seen at different viewing angles, for example, images corresponding to a front, side, oblique front, oblique rear, and other positions of an object. In this way, a stereoscopic effect may be obtained when an observer observes at a plurality of viewing angles. FIG. 7 shows a schematic diagram of a principle of an example of a multi-view three-dimensional display panel. In this example, the multi-view three-dimensional display panel includes a cylindrical lens array located on a light emitting side of the display panel, and the cylindrical lens CLen in the cylindrical lens array projects images of corresponding sub-pixels to different spatial positions corresponding to each viewing angle display position. For example, in FIG. 7, light emitted from a sub-pixel PXA is guided to an upper right direction under an action of the cylindrical lens Clen (the light is indicated by a double arrow), while light emitted from another sub-pixel PXB is guided to an upper left direction under an action of the cylindrical lens Clen (the light is represented by a single arrow). In this way, the two sub-pixels PXA and PXB may correspond to different viewing angle display positions, or used to achieve display at different viewing angle display positions. In some embodiments, one cylindrical lens CLen corresponds to a plurality of sub-pixels, and each sub-pixel corresponds to one viewing angle. When the display panel has sub-pixels of a plurality of colors, one viewing angle may correspond to sub-pixels of a plurality of different colors at the same time. For example, in the example shown in FIG. 8A, the multi-view three-dimensional display panel has 18 viewing angle display positions and has sub-pixels in three colors. Each viewing angle corresponds to one sub-pixel in each of the three colors. In this way, in fact, each pixel on the multi-view three-dimensional display panel will include 18×3=54 sub-pixels. However, the embodiments of the present disclosure are not limited to this, and the number of the viewing angle display positions of the multi-view three-dimensional display panel may be set as needed.

Figure 8A:
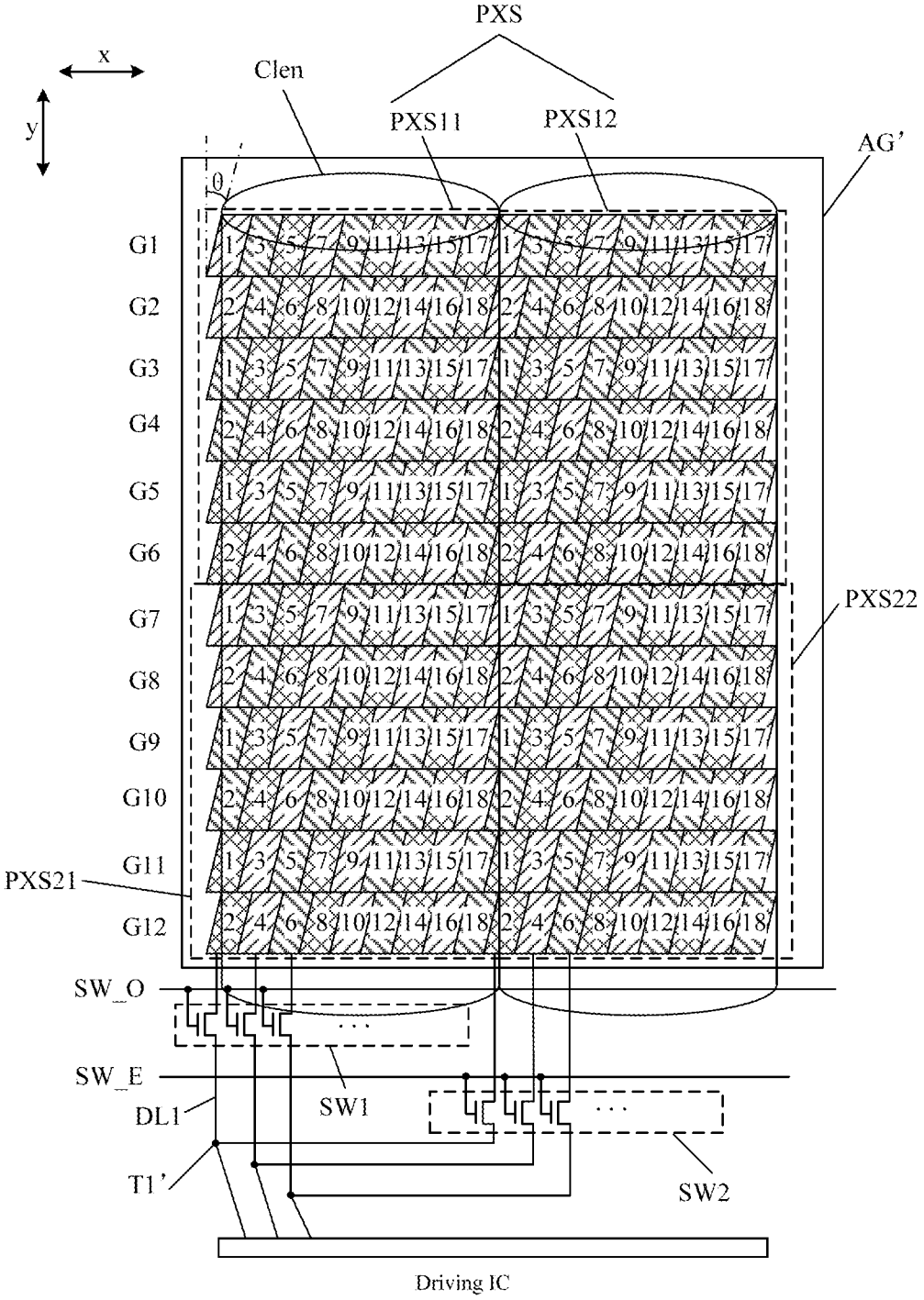
FIG. 8A shows a pixel distribution diagram of a multi-view three-dimensional display panel according to some embodiments of the present disclosure.

In some embodiments, the multi-view three-dimensional display panel may also be provided with the aforementioned sub-pixel association group AG'. Each sub-pixel association group AG' includes a plurality of three-dimensional sub-pixel groups PXS, and each three-dimensional sub-pixel group PXS includes sub-pixels of different colors for the plurality of viewing angle display positions. For example, FIG. 8A shows a complete sub-pixel association group AG', which includes four three-dimensional sub-pixel groups PXS, that is, a first three-dimensional sub-pixel group PXS11, a second three-dimensional sub-pixel group PXS12, a third three-dimensional sub-pixel group PXS21 and a fourth three-dimensional sub-pixel group PXS22. They form a 2×2 array of three-dimensional sub-pixel groups. In some embodiments, the multi-view three-dimensional display panel may include K viewing angle display positions, where K is an even number, and each three-dimensional sub-pixel group PXS may include K/2 columns of sub-pixels. The sub-pixels of different colors include first color sub-pixels, second color sub-pixels, and third color sub-pixels. In the example shown in FIG. 8A, there are periodic units in each column of sub-pixels, and each periodic unit is formed of two first color sub-pixels, two second color sub-pixels, and two third color sub-pixels in sequence. This arrangement of the sub-pixels spreads out the sub-pixels of various colors corresponding to the different viewing angle display positions, which is beneficial to achieve spatial color uniformity. In FIG. 8A, a marked number on each sub-pixel indicates which viewing angle display position it corresponds to.

Similar to the foregoing embodiment, the multi-view three-dimensional display panel may also have a first image display mode and a second image display mode. The first image display mode is used to display images with relatively high resolution and relatively low refresh rate, and the second image display mode is used to display images with relatively low resolution and relatively high refresh rate. In the first image display mode, data writing is independently performed on the plurality of sub-pixels of a same color in the sub-pixel association group AG'; and in the second image display mode, data writing is synchronously performed on the plurality of sub-pixels of the same color electrically connected to a same data line in the sub-pixel association group AG'.

In some embodiments, the multi-view three-dimensional display panel may include a plurality of three-dimensional sub-pixel groups PXS. The plurality of three-dimensional sub-pixel groups PXS includes a first three-dimensional sub-pixel group PXS11, a second three-dimensional sub-pixel group PXS12, the first three-dimensional sub-pixel group PXS11 and the second three-dimensional sub-pixel group PXS12 are adjacent in a second direction (for example, x direction in FIG. 8A), each group of three-dimensional sub-pixel groups includes J columns of sub-pixels PX, and each column of sub-pixels is connected to a data line DL. The multi-view three-dimensional display panel further includes a first group of switches SW1 and a second group of switches SW2, the number of switches in each group of the first group of switches SW1 and the second group of switches SW2 is not less than J. In some embodiments, the data line connected to a $H_{th}$ column of sub-pixels in the first three-dimensional sub-pixel group PXS11 is connected to a first node T1' through a $H_{th}$ switch in the first group of switches SW1, and the data line connected to a $H_{th}$ column of sub-pixels in the second three-dimensional sub-pixel group PXS12 is connected to the first node T1' through a $H_{th}$ switch in the second group of switches SW2, where H and J are integers, H is less than or equal to J. The first node T1' may be connected to a driving IC. In FIG. 8A, positions of the sub-pixel rows corresponding to a gate line G1 to a twelfth gate line G12 are marked with G1 to G12. For the sake of clarity of the illustration, specific lines of the first gate lines G1 to the twelfth gate line G12 are not shown in FIG. 8A.

Figure 8B:
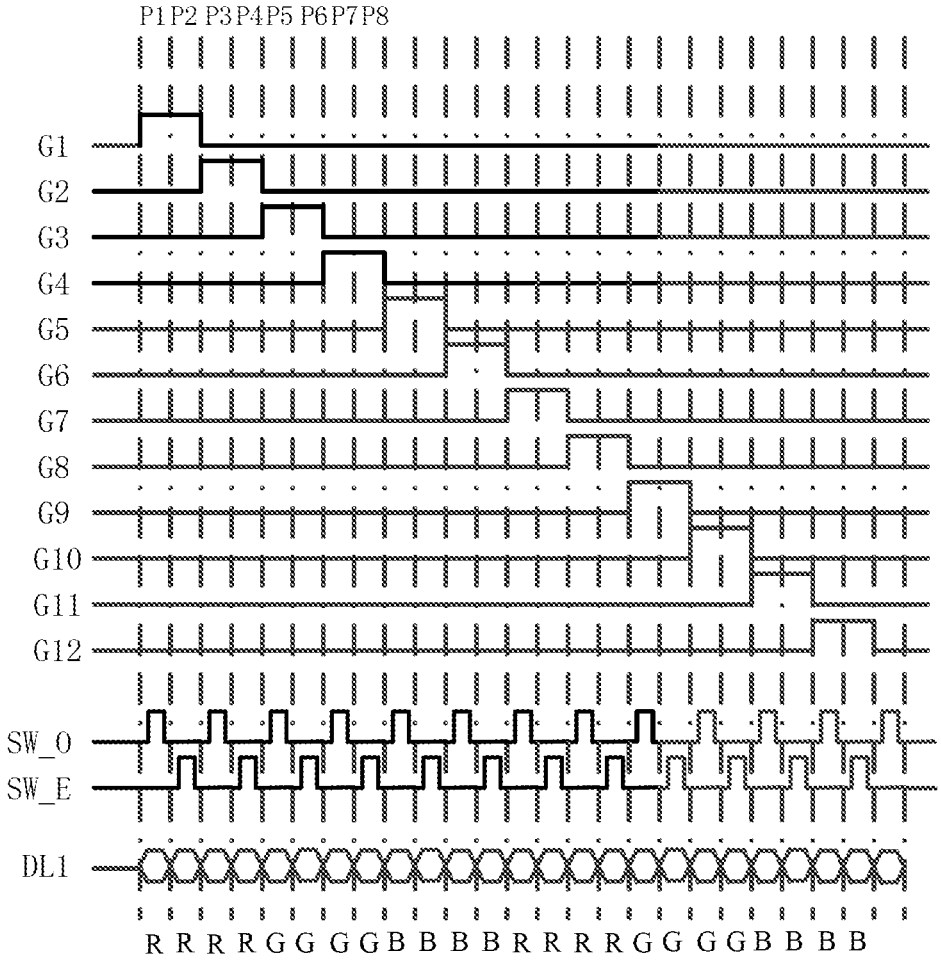
FIG. 8B is a schematic timing diagram of the display panel shown in FIG. 8A in a first image display mode.
Figure 8C:
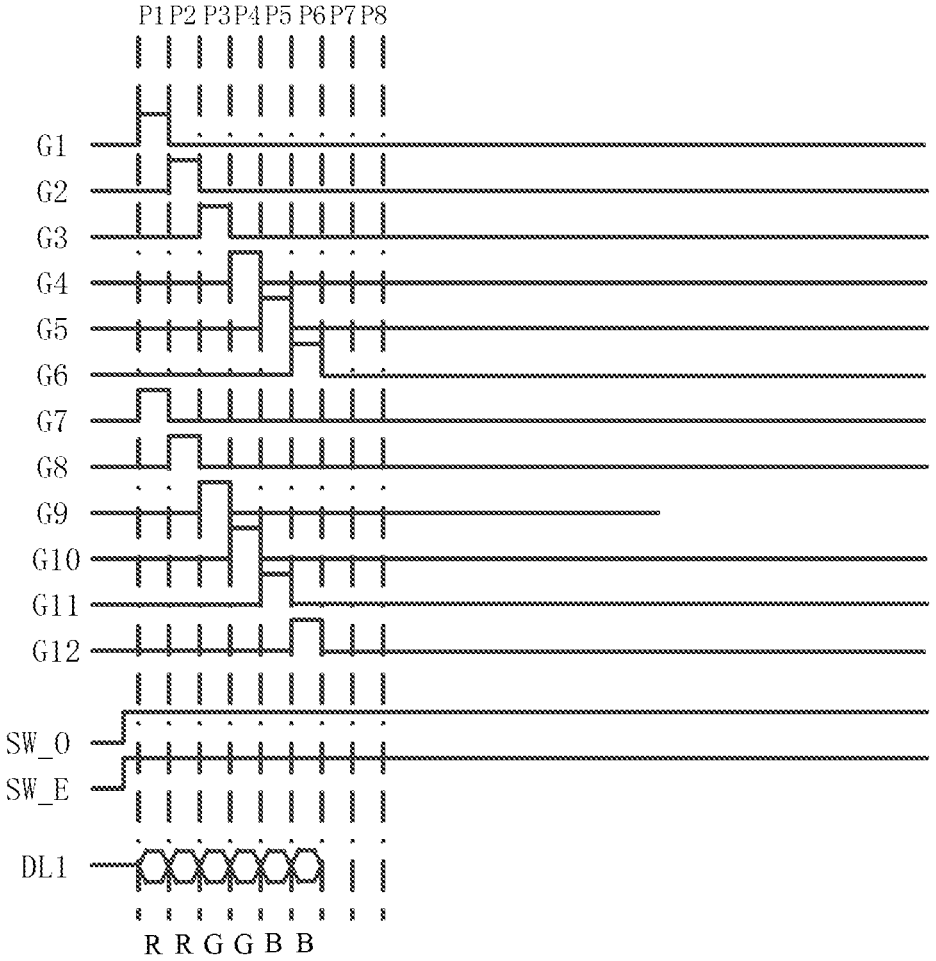
FIG. 8C is a schematic timing diagram of the display panel shown in FIG. 8A in a second image display mode.

In the first image display mode, a same row of sub-pixels are driven and displayed one by one. A specific timing diagram is shown in FIG. 8B. Each gate line is scanned row by row. The first group of switches SW1 and the second group of switches SW2 are turned on in turn (for example, it may be performed as follows). Similar to the embodiment of FIG. 4A, a signal SW_O in FIG. 8A, FIG. 8B, and FIG. 8C is a control signal used to control the first group of switches. In this example, the first group of switches SW1 will be turned on when the signal SW_O is at a high level; and the first group of switches SW1 will be turned off when the signal SW_O is at a low level. Similarly, in this example, when the signal SW_E is at a high level, the second group of switches SW2 will be turned on; when the signal SW_E is at a low level, the second group of switches SW2 will be turned off. However, the embodiments of the present disclosure are not limited to this. For example, the first group of switches SW1 may also be set to be turned off when the signal SW_O is at the high level and turned on when the signal SW_O is at the low level, or the second group of switches SW2 may also be set to turn off when the signal SW_E is at the high level and turn on when the signal SW_E is at the low level. In the second image display mode, the sub-pixels of the same color in the four three-dimensional sub-pixel groups in the same sub-pixel association group AG' are controlled by a same signal to be lit together. In this case, the first group of switches SW1 and the second group of switches SW2 are kept on all the time.

In the example shown in FIGS. 8A to 8C, each sub-pixel association group AG' includes 12 rows of sub-pixels. Each row of sub-pixels has a corresponding gate line. Therefore, each sub-pixel association group AG corresponds to 12 gate lines. In the first image display mode, in a first time period P1, the first gate line G1 is activated, the first group of switches SW1 are turned on and the second group of switches SW2 are turned off; in a second time period P2, the first gate line G1 continues to be activated, the second group of switches SW2 are turned on and the first group of switches SW1 are turned off; in a third period P3, the second gate line G2 is activated, the first group of switches SW1 are turned on and the second group of switches SW2 are turned off; in a fourth time period P4, the second gate line G2 continues to be activated, the second group of switches SW2 are turned on and the first group of switches SW1 are turned off; in a fifth time period P5, the third gate line G3 is activated, the first group of switches SW1 are turned on and the second group of switches SW2 are turned off; in a sixth time period P6, the third gate line G3 continues to be activated, the second group of switches SW2 are turned on and the first group of switches SW1 are turned off; in a seventh time period P7, the fourth gate line G4 is activated, the first group of switches SW1 are turned on and the second group of switches SW2 are turned off; in an eighth time period P8, the fourth gate line G4 continues to be activated, the second group of switches SW2 are turned on and the first group of switches SW1 are turned off. The following analogy will not be repeated here. Correspondingly, for the first data line DL1, data loaded in the above-mentioned first to eighth time periods correspond to the first to fourth rows of sub-pixels in sequence (for the example of FIG. 8A and FIG. 8B, the first row and the second row of sub-pixels are red sub-pixels, and the third and fourth rows are green sub-pixels). The following analogy will not be repeated here. In the second image display mode, in the first period P1, the first gate line G1 and the seventh gate line G7 are activated; in the second period P2, the second gate line G2 and the eighth gate line G8 are activated; in the third period P3, the third gate line G3 and the ninth gate line G9 are activated; in the fourth period P4, the fourth gate line G4 and the tenth gate line G10 are activated; in the fifth period P5, the fifth gate line G5 and the eleventh gate line G11 are activated; in the sixth period P6, the sixth gate line G6 and the twelfth gate line G12 are activated. In the second image display mode, the first group of switches SW1 and the second group of switches SW2 are kept on during each of the above-mentioned time periods. It may be seen from FIGS. 8B and 8C that the refresh rate of the second image display mode is faster.

In the example shown in FIG. 8A, each cylindrical lens Clen corresponds to 9 columns of sub-pixels. Therefore, the $H_{th}$ column of sub-pixels in the first three-dimensional sub-pixel group PXS11 and the $H_{th}$ column of sub-pixels in the second three-dimensional sub-pixel group PXS12 are spaced apart by 9 columns of sub-pixels, and the sub-pixels of the same color of the same viewing angle that are closest to each other in the same column of sub-pixels are spaced apart by six rows of sub-pixels. Therefore, in the second image display mode, as shown in FIG. 8C, the $n_{th}$ gate line Gn and the $n+6_{th}$ gate line G(n+6) have a same signal, and the $m_{th}$ data line and the $m+9_{th}$ gate line have a same signal, and m and n are positive integers.

In the example of FIG. 8A, an axis of the cylindrical lens Clen in the cylindrical lens array extends along a first direction (for example, y direction in FIG. 8A). An orthographic projection of the plurality of sub-pixels on a base substrate is inclined with respect to the first direction with an inclination angle θ, for example, between 5 degrees and 20 degrees, such as 11 degrees to 13 degrees. This helps reduce Moire pattern in three-dimensional display. In the example of FIG. 8A, in the first image display mode, the resolution of each image is, for example, 5120×1440, and the image refresh rate is 30 Hz; and in the second image display mode, the resolution of each image is, for example, 2560×720, and the image refresh rate is 120 Hz. The multi-view three-dimensional display requires providing independent sub-pixels for each different viewing angle. Thus, compared with a two-dimensional display panel, when the total number of sub-pixels is the same, the resolution of each image will be reduced. For example, for the embodiment shown in FIG. 8A, the number of rows of sub-pixels in each image is one-sixth of that in the case of a two-dimensional display panel, and the number of columns is one-third of that in the case of a two-dimensional display panel.

Figure 9:
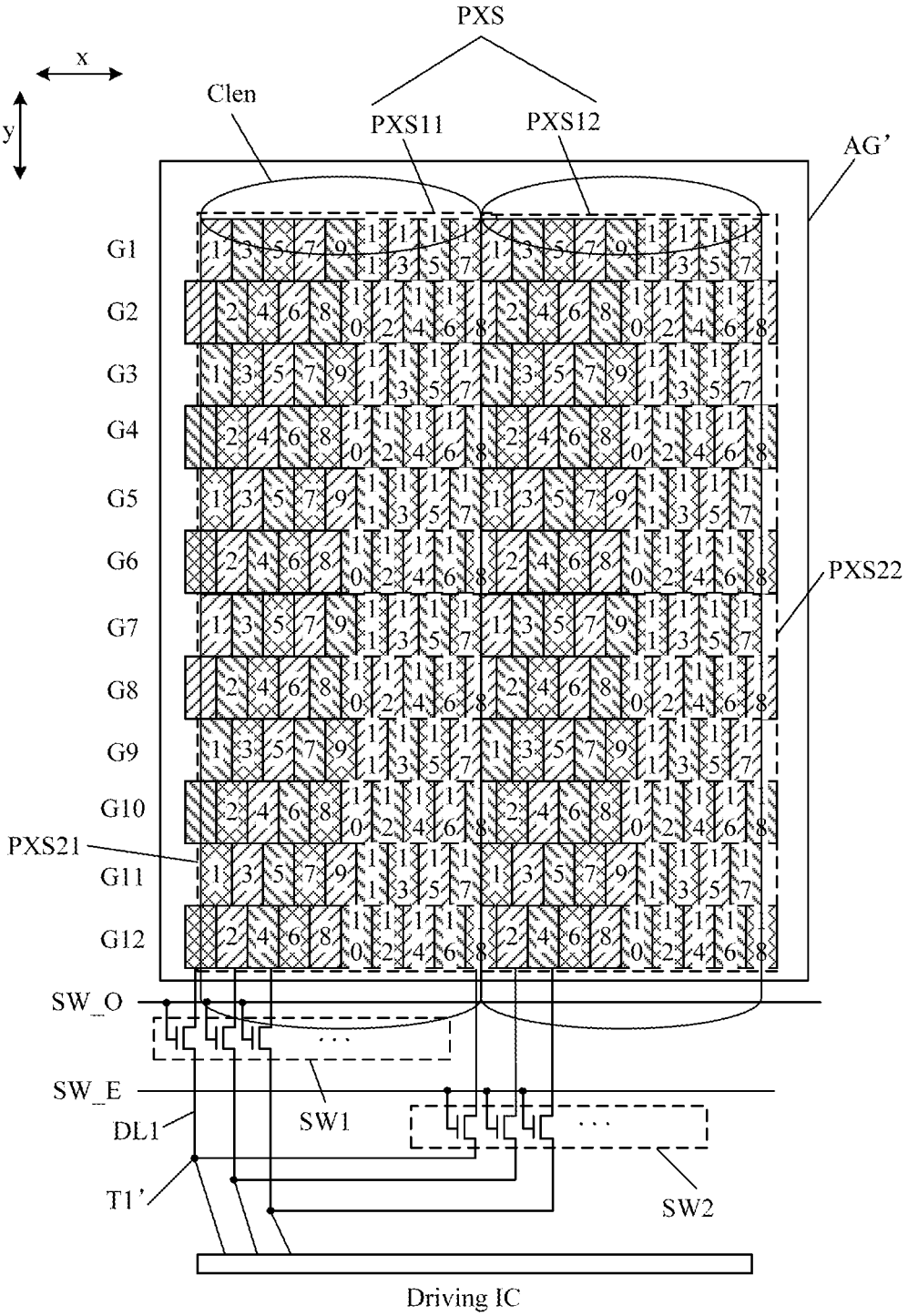
FIG. 9 shows a pixel distribution diagram of a multi-view three-dimensional display panel according to other embodiments of the present disclosure.

In other embodiments, the orthographic projection of the plurality of sub-pixels on the base substrate extends along the first direction, and even-numbered rows of sub-pixels are staggered in the second direction by a certain displacement (for example, half a sub-pixel) relative to odd-numbered rows of sub-pixels. As shown in FIG. 9, the sub-pixels are not inclined with respect to the axis of the cylindrical lens as in the example shown in FIG. 8A (for example, the direction of the sub-pixels with respect to the axis of the cylindrical lens (y direction in FIG. 9)), Alternatively, the odd-numbered rows of sub-pixels and even-numbered rows are staggered by half of the sub-pixel in a row direction (x direction in FIG. 9). This may also help to suppress Moire pattern. The driving control method in the example shown in FIG. 9 is the same as the example in FIG. 8A, and will not be repeated here.

Figure 10:
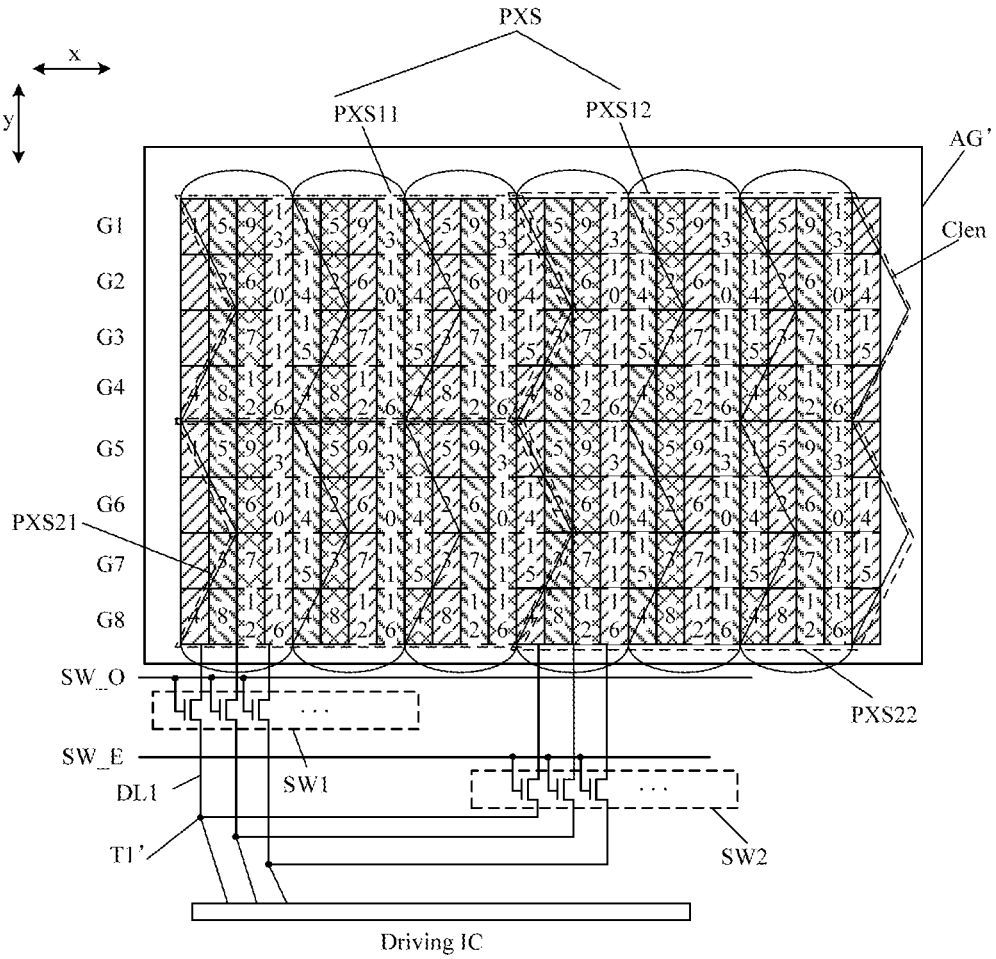
FIG. 10 shows a pixel distribution diagram of a multi-view three-dimensional display panel according to other embodiments of the present disclosure.

FIG. 10 shows a sub-pixel arrangement structure of a multi-view three-dimensional display panel according to other embodiments of the present disclosure. In this example, the sub-pixels are neither inclined nor staggered, but an arrangement direction of the cylindrical lens Clen is adjusted to suppress Moire pattern. As an example, as shown in FIG. 10, an orthographic projection of the cylindrical lens Clen in the cylindrical lens array on the base substrate is a broken line shape instead of a straight line shape as in the examples shown in FIGS. 8A and 9. For example, a distance W between two end points of each of the line segments in the row direction of the sub-pixels is about a width of two sub-pixels. In the example shown in FIG. 10, the multi-view three-dimensional display panel includes 16 viewing angle display positions. Each viewing angle display position is correspondingly provided with sub-pixels of the first color, sub-pixels of the second color, and sub-pixels of the third color. Therefore, a complete three-dimensional sub-pixel group PXS includes 3×16=48 sub-pixels. In the example shown in FIG. 10, the 48 sub-pixels PX are arranged in 4 rows and 12 columns, and each column of sub-pixels are sub-pixels of the same color. The driving control method is similar to the example shown in FIG. 8A, except that the number of data lines and gate lines is different, which will not be repeated here. The number and arrangement of sub-pixels of the multi-view three-dimensional display panel in the embodiments of the present disclosure are not limited to the above examples. For example, in some embodiments, the multi-view three-dimensional display panel may include K viewing angle display positions, K is a multiple of 4, and each three-dimensional sub-pixel group PXS includes 4 rows of sub-pixels PX and K/4 columns of sub-pixels PX, the second row of sub-pixels and the third row of sub-pixels of each three-dimensional sub-pixel group PXS are staggered in the second direction (for example, the row direction of the sub-pixels, x direction in FIG. 10) by one sub-pixel relative to the first row of sub-pixels and the fourth row of sub-pixels of each three-dimensional sub-pixel group. This may better adapt to the above-mentioned bent cylindrical lens.

Figure 11:
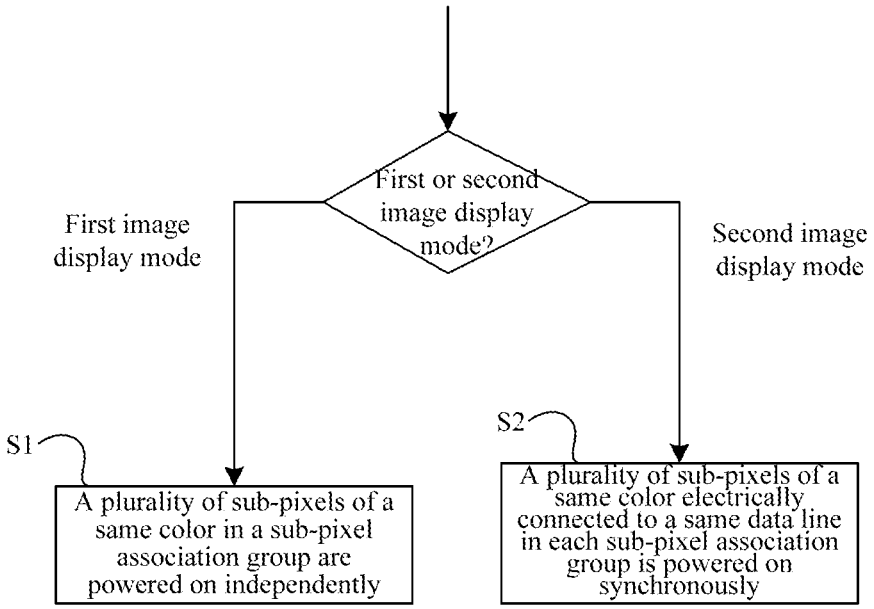
FIG. 11 is a flowchart of a method for driving a display panel according to some embodiments of the present disclosure.

The embodiments of the present disclosure also provide a method for driving a display panel. As shown in FIG. 11, the method may include:

In a first image display mode, data writing is independently performed on a plurality of sub-pixels of a same color in a sub-pixel association group (step S1); and in a second image display mode, data writing is synchronously performed on a plurality of sub-pixels of a same color electrically connected to a same data line in each sub-pixel association group (step S2).

As mentioned above, for example, a refresh rate of the first image display mode is lower than a refresh rate of the second image display mode, and a resolution is higher than a resolution of the second image display mode. In this way, static images and dynamic images may be optimized for display while keeping system resources unchanged. That is, the first image display mode with higher resolution and lower refresh rate is used for static images (more system resources are allocated to the resolution), while the second image display mode with higher refresh rate and lower resolution are used for dynamic images (more system resources are allocated to the refresh rate).

In some embodiments, a plurality of sub-pixels are arranged in a sub-pixel matrix of M rows and N columns, each row of sub-pixels extends along a second direction, each column of sub-pixels extends along a first direction, and each of at least one data line is electrically connected to more than one sub-pixel of a same color in a same row of the sub-pixel matrix. In the first image display mode, the first gate line G1 scans and turns on odd-numbered sub-pixels in a row of sub-pixels in a first time period P1, and the second gate line G2 scans and turns on even-numbered first sub-pixels in a second time period P2; and in the second image display mode, the first gate line G1 and the second gate line G2 scan and turn on each sub-pixel PX in the first row of sub-pixels in the first time period P1, for example, as shown in FIGS. 2A, 2B and 2C.

In some embodiments, for example, as shown in FIGS. 5A, 5B, and 5C, each of at least one data line DL is electrically connected to more than one sub-pixel of the same color in the same column of the sub-pixel matrix, and each data line is electrically connected to one sub-pixel PX in one row of the sub-pixel matrix, and is electrically connected to other sub-pixels of the same color in the same row through a switch element. In the first image display mode, the switch element is turned off, and in the second image display mode, the switch element is turned on.

In some embodiments, as shown in FIGS. 4A, 4B, and 4C, a plurality of sub-pixels are arranged in a sub-pixel matrix of M rows and N columns, and the plurality of sub-pixels include sub-pixels of a plurality of colors. Colors of the sub-pixels arranged in a same column are the same, and the sub-pixels of different colors in a same row of the sub-pixel matrix are periodically arranged one by one, each row of sub-pixels extends along a second direction, and each column of sub-pixels extends along a first direction, each of the at least one data line is electrically connected to more than one sub-pixel of the same color in the same row of the sub-pixel matrix, and the plurality of gate lines include a first gate line, a second gate line, a third gate line, and a fourth gate line. The display panel further includes a first group of switches and a second group of switches, and the number of color types of sub-pixels is G. The data line connected to a $2nG+i_{th}$ column of sub-pixels is connected to a second node through a $nG+i_{th}$ switch in the first group of switches, and the data line connected to a $(2n+1)G+i_{th}$ column of sub-pixels is connected to the second node through a $(n+1)G+i_{th}$ switch in the second group of switches, where n is an integer greater than or equal to zero and less than or equal to (N/2G), and i is an integer greater than or equal to 1 and less than or equal to G. For example, G may be equal to 3, that is, three colors of sub-pixels are provided on the display panel. In the first image display mode, the first gate line scans and turns on the first row of sub-pixels in a first time period and a second time period, the second gate line scans and turns on the second row of sub-pixels in a third time period and a fourth time period, the third gate line scans and turns on the third row of sub-pixels in a fifth time period and a sixth time period, and the fourth gate line scans and turns on the fourth row of sub-pixels in a seventh time period and an eighth time period, the first group of switches are turned on in the first, third, fifth, and seventh time periods, and are turned off in the second, fourth, the sixth time period and the eighth time period, and the second group of switches are turned on during the second time period, the fourth time period, the sixth time period, and the eighth time period, and are turned off in the first time period, the third time period, the fifth time period, and the seventh time period. In the second image display mode, the first gate line and the second gate line scan and turn on the first row of sub-pixels and the second row of sub-pixels in the first time period and the second time period, the third gate line and the fourth gate line scan and turn on the third row of sub-pixels and the fourth row of sub-pixels in the second and third time periods, the first group of switches and the second group of switches are kept on during the first time period, the second time period, the third time period, and the fourth time period.

In some embodiments, a plurality of sub-pixels are arranged in a sub-pixel matrix of M rows and N columns, and the plurality of sub-pixels include first color sub-pixels, second color sub-pixels, and third color sub-pixels, and a plurality of data lines include a first data line, a second data line, and a third data line. Colors of the sub-pixels in a same row of the sub-pixel matrix are the same, and each sub-pixel association group includes a plurality of first color sub-pixels in the first row of the sub-pixel matrix electrically connected to the first data line, a plurality of second color sub-pixels in the second row of the sub-pixel matrix electrically connected to the second data line, a plurality of third color sub-pixels in the third row of the sub-pixel matrix electrically connected to the first data line, a plurality of first color sub-pixels in the fourth row of the sub-pixel matrix electrically connected to the second data line, a plurality of second color sub-pixels in the fifth row of the sub-pixel matrix electrically connected to the first data line, a plurality of third color sub-pixels in the sixth row of the sub-pixel matrix electrically connected to the second data line. A plurality of gate lines include a first gate line, a second gate line, a third gate line, a fourth gate line, a fifth gate line, a sixth gate line, a seventh gate line, and an eighth gate line, the first gate line is electrically connected to odd-numbered sub-pixels in the first row of the sub-pixel matrix, the second gate line is electrically connected to even-numbered sub-pixels in the first row of the sub-pixel matrix, the third gate line is electrically connected to odd-numbered sub-pixels in the second row of the sub-pixel matrix, the fourth gate line is electrically connected to even-numbered sub-pixels in the second row of the sub-pixel matrix, the fifth gate line is electrically connected to odd-numbered sub-pixels in the third row of the sub-pixel matrix, the sixth gate line is electrically connected to even-numbered sub-pixels in the third row of the sub-pixel matrix, the seventh gate line is electrically connected to odd-numbered sub-pixels in the fourth row of the sub-pixel matrix, and the eighth gate line is electrically connected to even-numbered sub-pixels in the fourth row of the sub-pixel matrix.

In the first image display mode, the first gate line scans and turns on the odd-numbered sub-pixels in the first row of the sub-pixel matrix in a first time period, the second gate line and the third gate line scan and turn on the even-numbered sub-pixels in the first row and odd-numbered sub-pixels in the second row of the sub-pixel matrix in a second time period. The fourth gate line and the fifth gate line scan and turn on the even-numbered sub-pixels in the second row of the sub-pixel matrix and the odd-numbered sub-pixels in the third row of the sub-pixel matrix in a third time period, the sixth gate line and the seventh gate line scan and turn on the even-numbered sub-pixels in the third row of the sub-pixel matrix and the odd-numbered sub-pixel in the fourth row of the sub-pixel matrix in a fourth time period, the eighth gate line scans and turns on the even-numbered sub-pixels in the fourth row of the sub-pixel matrix. The sequence of subsequent other gate lines is deduced by analogy, and will not be repeated here.

In the second image display mode, the first gate line, the second gate line, the seventh gate line and the eighth gate line scan and turn on each sub-pixel in the first row of the sub-pixel matrix and each sub-pixel in the fourth row of the sub-pixel matrix in the first period P1 and the second period P2, the third gate line and the fourth gate line scan and turn on each sub-pixel in the second row of the sub-pixel matrix in the third and fourth time periods, the fifth gate line and the sixth gate line scan and turn on each sub-pixel in the third row of the sub-pixel matrix in the fifth and sixth time periods. The sequence of subsequent other gate lines is deduced by analogy, and will not be repeated here.

Figure 12:
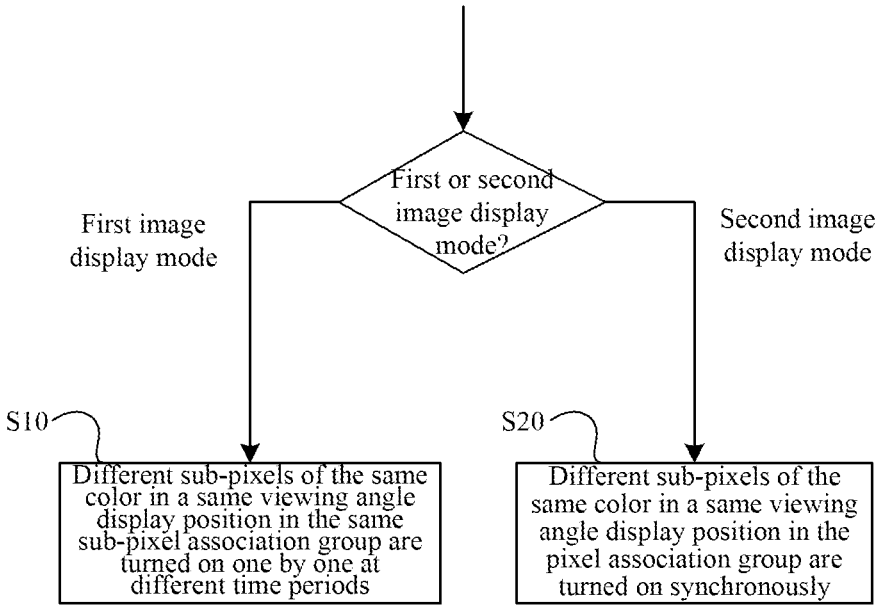
FIG. 12 is a flowchart of a method for driving a multi-view three-dimensional display panel according to some embodiments of the present disclosure.

FIG. 12 shows a flowchart of a method for driving a multi-view three-dimensional display panel according to some embodiments of the present disclosure. As mentioned above, the multi-view three-dimensional display panel includes a plurality of viewing angle display positions, each of the sub-pixel association groups includes a plurality of three-dimensional sub-pixel groups, and each three-dimensional sub-pixel group includes sub-pixels of different colors for a plurality of viewing angle display positions. The method includes:

In a first image display mode, different sub-pixels of the same color in a same viewing angle display position in the same sub-pixel association group are turned on one by one at different time periods (step S10), and in a second image display mode, different sub-pixels of the same color in a same viewing angle display position in the pixel association group are turned on synchronously (step S20). The specific example of the method for driving the multi-view three-dimensional display panel has been described in detail above in comparison with the arrangement of the sub-pixels on the display panel, and will not be repeated here.

In the embodiments of the present disclosure, the display panel may include an associated pixel control circuit (for example, it may be integrated in a driving IC), and the associated pixel control circuit may be configured to perform various controls on the sub-pixels in the first image display mode and the second image display mode. For example, in some embodiments, the associated pixel control circuit may be configured to independently perform data writing on the plurality of sub-pixels of the same color in the sub-pixel association group in the first image display mode; and configured to synchronously perform data writing on the plurality of sub-pixels of the same color electrically connected to the same data line in each sub-pixel association group. Specifically, in some embodiments, the associated pixel control circuit may also be configured to: in the first image display mode, the first gate line scans and turns on the first row of sub-pixels in the first time period and the second time period, the second gate line scans and turns on the second row of sub-pixels in the third and fourth time periods, and the third gate line scans and turns on the third row of sub-pixels in the fifth and sixth time periods, and the fourth gate line scans and turns on the fourth row of sub-pixels in the seventh and eighth time periods. The first group of switches are turned on in the first, third, fifth and seventh time periods and turned off in the second, fourth, sixth, and eighth time periods, and the second group of switches are turned on in the second, fourth, sixth eighth time periods and are turned off in the first, third, fifth and seventh time periods. In the second image display mode, the first gate line and the second gate line scan and turn on the first row of sub-pixels and the second row of sub-pixels in the first time period and the second time period, and the third gate line and the fourth gate line scans and turns on the third row of sub-pixels and the fourth row of sub-pixels in the second time period and the third time period. The first group of switches and the second group of switches are kept on in the first, second, third and fourth time periods. In other embodiments, the associated pixel control circuit may also be configured to: in the first image display mode, the first gate line scans in the first time period, the second gate line and the third gate line scan in the second time period, the fourth gate line and the fifth gate line scan in the third time period, the sixth gate line and the seventh gate line scan in the fourth time period, and the eighth gate line and the ninth gate line scan in the fifth time period, the tenth gate line and the eleventh gate line scan in the sixth time period, and the twelfth gate line scans in the seventh time period. In the second image display mode, the first gate line, the second gate line, the seventh gate line, and the eighth gate line scan in the first time period and the second time period, and the third gate line, the fourth gate line, the ninth gate line and the tenth gate line scan in the third period and the fourth period, and the fifth gate line, the sixth gate line, the eleventh gate line and the twelfth gate line scan in the fifth time period and the sixth time period.

The above detailed description has explained many embodiments of the above-mentioned display panel by using schematic diagrams, flowcharts, and/or examples. In the case where such schematic diagrams, flowcharts, and/or examples include one or more functions and/or operations, those skilled in the art should understand that each function and/or operation in such schematic diagrams, flowcharts, or examples may be implemented individually and/or together through various structures, hardware, software, firmware or substantially any combination thereof. In an embodiment, several parts of the subject matter described in the embodiments of the present invention may be implemented by an application specific integrated circuit (ASIC), a field programmable gate array (FPGA), a digital signal processor (DSP), or other integrated formats. However, those skilled in the art should recognize that some aspects of the embodiments disclosed herein may be equivalently implemented in an integrated circuit in whole or in part, implemented as one or more computer programs running on one or more computers (for example, implemented as one or more programs running on one or more computer systems), implemented as one or more programs running on one or more processors (for example, implemented as one or more programs running on one or more programs running on one or more microprocessors), implemented as firmware, or substantially implemented as any combination thereof. And according to the present disclosure, those skilled in the art will be equipped with abilities of designing circuits and/or writing software and/or firmware code. In addition, those skilled in the art will recognize that the mechanism of the subject matter of the present disclosure may be distributed as various forms of program products, and regardless of the specific type of signal bearing medium that is actually used to perform the distribution, The exemplary embodiments of the subject matter of the present disclosure are all applicable. Examples of the signal bearing media include, but are not limited to: recordable media, such as floppy disks, hard drives, optical disks (CD, DVD), digital tapes, computer storages, etc.; and transmission media, such as digital and/or analog communication media (such as, fiber optic cables, waveguides, wired communication links, wireless communication links, etc.).

The embodiments of the present disclosure also disclose an electronic device including the display panel as described in any of the above embodiments. The electronic device may be any product or component with display function such as electronic paper, mobile phone, tablet computer, liquid crystal display, liquid crystal TV, OLED (organic electroluminescence) display, OLED TV, notebook computer display, digital photo frame, navigator, etc.

Although the present disclosure has been described with reference to the accompanying drawings, the embodiments disclosed in the accompanying drawings are intended to exemplify the embodiments of the present disclosure, and should not be understood as a limitation of the present disclosure. The size ratios in the drawings are only schematic and should not be construed as limiting the present disclosure.

The above-mentioned embodiments only exemplarily illustrate the principle and the structure of the present disclosure, but are not used to limit the present disclosure. Those skilled in the art should understand that any changes and modifications made to the present disclosure without departing from the general concept of the present disclosure are all within the scope of the present disclosure. The protection scope of the present disclosure shall be subject to the scope defined by the claims.

What is claimed is:

1. A display panel, comprising:

a base substrate;

a plurality of sub-pixels arranged in a matrix; and a plurality of data lines extending along a first direction and a plurality of gate lines extending along a second direction, wherein the data line intersect the gate line;

wherein at least some of the plurality of sub-pixels are divided into a plurality of sub-pixel association groups, each of the plurality of sub-pixel association groups comprises a plurality of sub-pixels of a same color electrically connected to a same data line, and the display panel has a first image display mode and a second image display mode;

wherein the display panel further comprises an associated pixel control circuit, configured to independently perform data writing on the plurality of sub-pixels of the same color in the sub-pixel association group in the first image display mode; and synchronously perform data writing on the plurality of sub-pixels of the same color electrically connected to the same data line in each of the plurality of sub-pixel association groups in the second image display mode; and wherein the plurality of sub-pixels are arranged in a sub-pixel matrix of M rows and N columns, each row of sub-pixels extends along the second direction, each column of sub-pixels extends along the first direction, each of the at least one data line is electrically connected to more than one sub-pixel of the same color in a same row of the sub-pixel matrix, and a refresh rate of the first image display mode is lower than a refresh mode of the second image display mode, and a resolution of the first image display mode is higher than a resolution of the second image display mode.

2. The display panel according to claim 1, wherein each of the plurality of sub-pixel association groups comprises sub-pixels in a plurality of rows of the sub-pixel matrix, in the first image display mode, more than one gate line respectively electrically connected to the plurality of sub-pixels of the same color in each of the plurality of sub-pixel association groups is scanned independently, in the second image display mode, more than one gate line respectively electrically connected to the plurality of sub-pixels of the same color in each of the plurality of sub-pixel association groups is scanned synchronously.

3. The display panel according to claim 2, wherein the plurality of sub-pixels comprises sub-pixels of a plurality of colors, colors of the sub-pixels in a same column of the sub-pixel matrix are the same, or sub-pixels of different colors are periodically arranged in the same column of the sub-pixel matrix.

4. The display panel according to claim 2, wherein the same data line is electrically connected to more than one sub-pixel of the same color in the same row of the sub-pixel matrix through a switch element, or electrically connected to more than one sub-pixel of the same color in the same row of the sub-pixel matrix directly.

5. The display panel according to claim 2, wherein the plurality of sub-pixels comprise a first color sub-pixel, a second color sub-pixel and a third color sub-pixel, the plurality of data lines comprise a first data line, a second data line and a third data line, each of the plurality of sub-pixel association groups comprises a plurality of first color sub-pixels electrically connected to the first data line, a plurality of second color sub-pixels electrically connected to the second data line, and a plurality of third color sub-pixels electrically connected to the third data line.

6. The display panel according to claim 2, wherein colors of the sub-pixels in the same column of the sub-pixel matrix are the same, and the sub-pixels of different colors are periodically arranged one by one in the same row of the sub-pixel matrix, each row of sub-pixels extends along the second direction, each column of sub-pixels extends along the first direction, each of the at least one data line is electrically connected to more than one sub-pixel of the same color in the same row of the sub-pixel matrix, the plurality of gate lines comprise a first gate line, a second gate line, a third gate line and a fourth gate line, and the display panel further comprises a first group of switches and a second group of switches, and a number of color types of the sub-pixels is G, wherein a data line connected to a $2nG+i_{th}$ column of sub-pixels is connected to a second node through a $nG+i_{th}$ switch in the first group of switches, and a data line connected to a $(2n+1)G+i_{th}$ column of sub-pixels is connected to the second node through a $(n+1)\ G+i_{th}$ switch in the second group of switches, wherein n is an integer greater than or equal to zero and less than or equal to (N/2G), and i is an integer greater than or equal to 1 and less than or equal to G; and wherein the associated pixel control circuit is configured so that:

in the first image display mode, the first gate line scans and turns on the first row of sub-pixels in a first time period and a second time period, the second gate line scans and turns on the second row of sub-pixels in a third time period and a fourth time period, and the third gate line scans and turns on the third row of sub-pixels in a fifth time period and a sixth time period, and the fourth gate line scans and turns on the fourth row of sub-pixels in a seventh time period and an eighth time period, the first group of switches are turned on in the first time period, the third time period, the fifth time period and the seventh time period and turned off in the second time period, the fourth time period, the sixth time period, and the eighth time period, and the second group of switches are turned on in the second time period, the fourth time period, the sixth time period and the eighth time period and are turned off in the first time period, the third time period, the fifth time period and the seventh time period; and in the second image display mode, the first gate line and the second gate line scan and turn on the first row of sub-pixels and the second row of sub-pixels in the first time period and the second time period, and the third gate line and the fourth gate line scans and turns on the third row of sub-pixels and the fourth row of sub-pixels in the second time period and the third time period, the first group of switches and the second group of switches are kept on in the first time period, the second time period, the third time period and the fourth time period.

7. The display panel according to claim 2, wherein colors of the sub-pixels in a same row of the sub-pixel matrix are the same, and each of the plurality of sub-pixel association groups comprises a plurality of first color sub-pixels in the first row of the sub-pixel matrix electrically connected to the first data line, a plurality of second color sub-pixels in the second row of the sub-pixel matrix electrically connected to the second data line, a plurality of third color sub-pixels in the third row of the sub-pixel matrix electrically connected to the first data line, a plurality of first color sub-pixels in the fourth row of the sub-pixel matrix electrically connected to the second data line, a plurality of second color sub-pixels in the fifth row of the sub-pixel matrix electrically connected to the first data line, a plurality of third color sub-pixels in the sixth row of the sub-pixel matrix electrically connected to the second data line, and wherein the plurality of gate lines comprise a first gate line, a second gate line, a third gate line, a fourth gate line, a fifth gate line, a sixth gate line, a seventh gate line, an eighth gate line, a ninth gate line, a tenth gate line, an eleventh gate line and a twelfth gate line, the first gate line is electrically connected to an odd-numbered sub-pixel in the first row of the sub-pixel matrix, and the second gate line is electrically connected to an even-numbered sub-pixel in the first row of the sub-pixel matrix, the third gate line is electrically connected to an odd-numbered sub-pixel in the second row of the sub-pixel matrix, the fourth gate line is electrically connected to an even-numbered sub-pixel in the second row of the sub-pixel matrix, the fifth gate line is electrically connected to an odd-numbered sub-pixel in the third row of the sub-pixel matrix, the sixth gate line is electrically connected to an even-numbered sub-pixel in the third row of the sub-pixel matrix, the seventh gate line is electrically connected to an odd-numbered sub-pixel in the fourth row of the sub-pixel matrix, the eighth gate line is electrically connected to an even-numbered sub-pixel in the fourth row of the sub-pixel matrix, the ninth gate line is electrically connected to an odd-numbered sub-pixel in the fifth row of the sub-pixel matrix, the tenth gate line is electrically connected to an even-numbered sub-pixel in the fifth row of the sub-pixel matrix, the eleventh gate line is electrically connected to an odd-numbered sub-pixel in the sixth row of the sub-pixel matrix, the twelfth gate line is electrically connected to an even-numbered sub-pixel in the sixth row of the sub-pixel matrix, wherein the associated pixel control circuit is configured so that:

in the first image display mode, the first gate line scans in a first time period, the second gate line and the third gate line scan in a second time period, the fourth gate line and the fifth gate line scan in a third time period, the sixth gate line and the seventh gate line scan in a fourth time period, and the eighth gate line and the ninth gate line scan in a fifth time period, the tenth gate line and the eleventh gate line scan in a sixth time period, and the twelfth gate line scans in a seventh time period;

in the second image display mode, the first gate line, the second gate line, the seventh gate line, and the eighth gate line scan in the first time period and the second time period, and the third gate line, the fourth gate line, the ninth gate line and the tenth gate line scan in the third period and the fourth period, and the fifth gate line, the sixth gate line, the eleventh gate line and the twelfth gate line scan in the fifth time period and the sixth time period.

8. The display panel according to claim 1, wherein the display panel is a multi-view three-dimensional display panel comprising a plurality of viewing angle display positions, each of the plurality of sub-pixel association groups comprises a plurality of three-dimensional sub-pixel groups, and each of the plurality of three-dimensional sub-pixel groups comprises sub-pixels of different colors for the plurality of viewing angle display positions.

9. The display panel according to claim 8, wherein the multi-view three-dimensional display panel comprises K viewing angle display positions, wherein K is an even number, each of the plurality of three-dimensional sub-pixel groups comprises K/2 columns of sub-pixels, the sub-pixels of different colors comprise a first color sub-pixel, a second color sub-pixel, and a third color sub-pixel, a periodic unit is included in each column of sub-pixels, and each periodic unit is formed of two first color sub-pixels, two second color sub-pixels, and two third color sub-pixels in sequence.

10. The display panel according to claim 9, further comprising a cylindrical lens array located on a light emitting side of the display panel, wherein an axis of the cylindrical lens in the cylindrical lens array extends along the first direction, wherein orthographic projections of the plurality of sub-pixels on a base substrate are respectively inclined with respect to the first direction, or orthographic projections of the plurality of sub-pixels on a base substrate extend along the first direction, an even-numbered row of sub-pixels is staggered in the second direction by half a sub-pixel relative to an odd-numbered row of sub-pixels.

11. The display panel according to claim 8, further comprising a cylindrical lens array located on a light emitting side of the display panel, an orthographic projection of the cylindrical lens in the cylindrical lens array on the base substrate has a broken line shape, the multi-view three-dimensional display panel comprises K viewing angle display positions, K is a multiple of 4, each of the plurality of three-dimensional sub-pixel groups comprises 4 rows of sub-pixels and K/4 columns of sub-pixels, a second row of sub-pixels and a third row of sub-pixels of each of the plurality of three-dimensional sub-pixel groups are staggered in the second direction by one sub-pixel relative to a first row of sub-pixels and a fourth row of sub-pixels of said each of the plurality of three-dimensional sub-pixel groups.

12. The display panel according to claim 8, wherein the plurality of three-dimensional sub-pixel groups comprises a first three-dimensional sub-pixel group and a second three-dimensional sub-pixel group adjacent in the second direction, each group of three-dimensional sub-pixel groups comprises J columns of sub-pixels, and each of the J columns of sub-pixels is connected to a data line, the display panel further comprises a first group of switches and a second group of switches, the number of switches in each of the first group of switches and the second group of switches is not less than J, wherein a data line connected to a $H_{th}$ column of sub-pixels in the first three-dimensional sub-pixel group is connected to a first node through a $H_{th}$ switch in the first group of switches, and a data line connected to a $H_{th}$ column of sub-pixels in the second three-dimensional sub-pixel group is connected to the first node through a $H_{th}$ switch in the second group of switches, H and J are integers, and H is less than or equal to J.

13. A method for driving the display panel according to claim 1, comprising:

independently performing data writing on the plurality of sub-pixels of the same color in the sub-pixel association group in the first image display mode; and synchronously performing data writing on the plurality of sub-pixels of the same color electrically connected to the same data line in each of the plurality of sub-pixel association groups in the second image display mode.

14. The method according to claim 13, wherein the plurality of gate lines comprises a first gate line and a second gate line, the plurality of sub-pixels are arranged as a sub-pixel matrix of M rows and N columns, each row of sub-pixels extends along the second direction, each column of sub-pixels extends along the first direction, each of the at least one data line is electrically connected to more than one sub-pixel of a same color in a same row of the sub-pixel matrix, and wherein in the first image display mode, the first gate line scans and turns on an odd-numbered sub-pixel in a first row of sub-pixels in a first time period, the second gate line scans and turns on an even-numbered sub-pixel in the first row of sub-pixels in a second time period; and in the second image display mode, the first gate line and the second gate line scan and turn on each sub-pixel in the first row of sub-pixels in the first period.

15. The method according to claim 13, wherein the plurality of sub-pixels are arranged as a sub-pixel matrix of M rows and N columns, each row of sub-pixels extends along the second direction, each column of sub-pixels extends along the first direction, each of the at least one data line is electrically connected to more than one sub-pixel of the same color in the same row of the sub-pixel matrix, and each data line is electrically connected to one sub-pixel in the same row of the sub-pixel matrix, and is electrically connected to other sub-pixels of the same color in the same row through a switch element, and wherein the switch element is turned off in the first image display mode, and the switch element is turned on in the second image display mode.

16. The display panel according to claim 13, wherein the plurality of sub-pixels are arranged as a sub-pixel matrix of M rows and N columns, the plurality of sub-pixels comprises sub-pixels of a plurality of colors, colors of the sub-pixels in a same column of the sub-pixel matrix are the same, and the sub-pixels of different colors are periodically arranged one by one in the same row of the sub-pixel matrix, each row of sub-pixels extends along the second direction, each column of sub-pixels extends along the first direction, each of the at least one data line is electrically connected to more than one sub-pixel of the same color in the same row of the sub-pixel matrix, the plurality of gate lines comprise a first gate line, a second gate line, a third gate line and a fourth gate line, and the display panel further comprises a first group of switches and a second group of switches, and a number of color types of the sub-pixels is G, wherein a data line connected to a $2nG+i_{th}$ column of sub-pixels is connected to a second node through a $nG+i_{th}$ switch in the first group of switches, and a data line connected to a $(2n+1)G+i_{th}$ column of sub-pixels is connected to the second node through a $(n+1)\ G+i_{th}$ switch in the second group of switches, wherein n is an integer greater than or equal to zero and less than or equal to (N/2G), and i is an integer greater than or equal to 1 and less than or equal to G; and in the first image display mode, the first gate line scans and turns on the first row of sub-pixels in a first time period and a second time period, the second gate line scans and turns on the second row of sub-pixels in a third time period and a fourth time period, and the third gate line scans and turns on the third row of sub-pixels in a fifth time period and a sixth time period, and the fourth gate line scans and turns on the fourth row of sub-pixels in a seventh time period and an eighth time period, the first group of switches are turned on in the first time period, the third time period, the fifth time period and the seventh time period and turned off in the second time period, the fourth time period, the sixth time period, and the eighth time period, and the second group of switches are turned on in the second time period, the fourth time period, the sixth time period and the eighth time period and are turned off in the first time period, the third time period, the fifth time period and the seventh time period; and in the second image display mode, the first gate line and the second gate line scan and turn on the first row of sub-pixels and the second row of sub-pixels in the first time period and the second time period, and the third gate line and the fourth gate line scans and turns on the third row of sub-pixels and the fourth row of sub-pixels in the second time period and the third time period, the first group of switches and the second group of switches are kept on in the first time period, the second time period, the third time period and the fourth time period.

17. The method according to claim 13, wherein the plurality of sub-pixels are arranged as a sub-pixel matrix of M rows and N columns, each row of sub-pixels extend along the second direction, each column of sub-pixels extends along the first direction, the plurality of sub-pixels comprises a first color sub-pixel, a second color sub-pixel, and a third color sub-pixel, and the plurality of data lines comprises a first data line, a second data line, and a third data line, and wherein colors of the sub-pixels in a same row of the sub-pixel matrix are the same, and each of the plurality of sub-pixel association groups comprises a plurality of first color sub-pixels in the first row of the sub-pixel matrix electrically connected to the first data line, a plurality of second color sub-pixels in the second row of the sub-pixel matrix electrically connected to the second data line, a plurality of third color sub-pixels in the third row of the sub-pixel matrix electrically connected to the first data line, a plurality of first color sub-pixels in the fourth row of the sub-pixel matrix electrically connected to the second data line, a plurality of second color sub-pixels in the fifth row of the sub-pixel matrix electrically connected to the first data line, a plurality of third color sub-pixels in the sixth row of the sub-pixel matrix electrically connected to the second data line, and wherein the plurality of gate lines comprise a first gate line, a second gate line, a third gate line, a fourth gate line, a fifth gate line, a sixth gate line, a seventh gate line, an eighth gate line, a ninth gate line, a tenth gate line, an eleventh gate line and a twelfth gate line, the first gate line is electrically connected to an odd-numbered sub-pixel in the first row of the sub-pixel matrix, and the second gate line is electrically connected to an even-numbered sub-pixels in the first row of the sub-pixel matrix, the third gate line is electrically connected to an odd-numbered sub-pixel in the second row of the sub-pixel matrix, the fourth gate line is electrically connected to an even-numbered sub-pixel in the second row of the sub-pixel matrix, the fifth gate line is electrically connected to an odd-numbered sub-pixel in the third row of the sub-pixel matrix, the sixth gate line is electrically connected to an even-numbered sub-pixel in the third row of the sub-pixel matrix, the seventh gate line is electrically connected to an odd-numbered sub-pixel in the fourth row of the sub-pixel matrix, the eighth gate line is electrically connected to an even-numbered sub-pixel in the fourth row of the sub-pixel matrix, the ninth gate line is electrically connected to an odd-numbered sub-pixel in the fifth row of the sub-pixel matrix, the tenth gate line is electrically connected to an even-numbered sub-pixel in the fifth row of the sub-pixel matrix, the eleventh gate line is electrically connected to an odd-numbered sub-pixel in the sixth row of the sub-pixel matrix, the twelfth gate line is electrically connected to an even-numbered sub-pixel in the sixth row of the sub-pixel matrix, in the first image display mode, the first gate line scans in a first time period, the second gate line and the third gate line scan in a second time period, the fourth gate line and the fifth gate line scan in a third time period, the sixth gate line and the seventh gate line scan in a fourth time period, and the eighth gate line and the ninth gate line scan in a fifth time period, the tenth gate line and the eleventh gate line scan in a sixth time period, and the twelfth gate line scans in a seventh time period; in the second image display mode, the first gate line, the second gate line, the seventh gate line, and the eighth gate line scan in the first time period and the second time period, and the third gate line, the fourth gate line, the ninth gate line and the tenth gate line scan in the third period and the fourth period, and the fifth gate line, the sixth gate line, the eleventh gate line and the twelfth gate line scan in the fifth time period and the sixth time period.

18. The method according to claim 13, wherein the display panel is a multi-view three-dimensional display panel comprising a plurality of viewing angle display positions, each of the plurality of sub-pixel association groups comprises a plurality of three-dimensional sub-pixel groups, and each of the plurality of three-dimensional sub-pixel groups comprises sub-pixels of different colors for the plurality of viewing angle display positions, and the method comprises:

turning on different sub-pixels of the same color in a same viewing angle display position in a same sub-pixel association group one by one at different time periods in the first image display mode, and synchronously turning on the different sub-pixels of the same color in the same viewing angle display position in the same pixel association group in the second image display mode.

19. An electronic device, comprising the display panel according to claim 1.

* * * * *